US007406278B2

(12) United States Patent
Katsuyama et al.

(10) Patent No.: US 7,406,278 B2
(45) Date of Patent: Jul. 29, 2008

(54) POWDER CONTAINER HAVING A LOWER SECTION WITH MULTIPLE PARTS WHICH ROTATABLY ENGAGE WITH EACH OTHER

(75) Inventors: Goro Katsuyama, Kanagawa (JP); Nobuo Iwata, Kanagawa (JP); Nobuo Kasahara, Kanagawa (JP); Satoshi Muramatsu, Tokyo (JP); Junichi Matsumoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/565,814

(22) Filed: Dec. 1, 2006

(65) Prior Publication Data

US 2007/0092303 A1 Apr. 26, 2007

Related U.S. Application Data

(63) Continuation of application No. 10/514,832, filed as application No. PCT/JP03/11707 on Sep. 12, 2003, now Pat. No. 7,277,664.

(30) Foreign Application Priority Data

| | | |
|---|---|---|
| Sep. 20, 2002 | (JP) | 2002-275691 |
| Sep. 20, 2002 | (JP) | 2002-276022 |
| Feb. 5, 2003 | (JP) | 2003-028700 |
| Feb. 5, 2003 | (JP) | 2003-028718 |

(51) Int. Cl.
*G03G 15/08* (2006.01)

(52) U.S. Cl. ..... 399/258; 399/260; 399/262; 222/DIG. 1

(58) Field of Classification Search ..... 399/258, 399/259, 260, 262; 222/DIG. 1
See application file for complete search history.

(56) References Cited

U.S. PATENT DOCUMENTS 4,752,807 A 6/1988 Mort (Continued)

FOREIGN PATENT DOCUMENTS

JP 11-30906 2/1999

(Continued)

OTHER PUBLICATIONS

U.S. Appl. No. 10/829,227, filed Apr. 22, 2004, Muramatsu, et al.

(Continued)

*Primary Examiner*—David M. Gray
*Assistant Examiner*—Laura K Roth
(74) *Attorney, Agent, or Firm*—Oblon, Spivak, McClelland, Maier & Neustadt, P.C.

(57) ABSTRACT

A part of a toner supply path is formed in a setting unit, and a nozzle coupled to a toner container is provided, wherein the fitting direction of the toner container to the setting unit and the coupling direction of the nozzle to the toner container are different. There is a powder container having an upper section and a multi-part lower section. The multi-part lower section has an upper portion and a lower portion, the lower portion having an opening which is perpendicular to an opening of the upper portion. The upper and lower portions are rotatably engaged such that the upper portion and the lower portion are engaged with each other when rotated to a first position relative to each other, and the upper portion and the lower portion are unengaged with each other when rotated to a second position relative to each other.

40 Claims, 19 Drawing Sheets

U.S. PATENT DOCUMENTS

| | | | | |
|---|---|---|---|---|
| 5,226,863 | A | 7/1993 | Kimura | |
| 5,248,847 | A | 9/1993 | Aoyama | |
| 5,537,197 | A * | 7/1996 | Fujishiro et al. | 399/262 |
| 5,890,040 | A * | 3/1999 | Matsuoka et al. | 399/262 |
| 6,035,164 | A | 3/2000 | Baek | |
| 6,393,241 | B1 | 5/2002 | Matsumoto et al. | |
| 6,507,720 | B2 | 1/2003 | Kabumoto et al. | |
| 6,628,915 | B2 | 9/2003 | Muramatsu et al. | |
| 6,691,896 | B2 * | 2/2004 | Meshberg | |
| 6,871,034 | B2 | 3/2005 | Muramatsu et al. | |
| 6,882,817 | B2 | 4/2005 | Kita | |
| 7,085,522 | B2 | 8/2006 | Muramatsu et al. | |
| 7,133,629 | B2 | 11/2006 | Kita | |
| 7,184,691 | B2 | 2/2007 | Kita et al. | |
| 7,221,891 | B2 | 5/2007 | Matsumoto et al. | |
| 7,248,824 | B2 | 7/2007 | Takami | |
| 7,257,348 | B2 | 8/2007 | Matsumoto et al. | |
| 7,277,664 | B2 | 10/2007 | Katsuyama et al. | |
| 2001/0051062 | A1 | 12/2001 | Yanagisawa et al. | |
| 2002/0039502 | A1 | 4/2002 | Matsumoto et al. | |
| 2003/0081969 | A1 | 5/2003 | Muramatsu et al. | |
| 2003/0215267 | A1 | 11/2003 | Kita | |
| 2004/0131392 | A1 | 7/2004 | Matsumoto et al. | |
| 2005/0117936 | A1 | 6/2005 | Takami | |
| 2005/0226655 | A1 | 10/2005 | Katsuyama et al. | |
| 2005/0281592 | A1 | 12/2005 | Muramatsu et al. | |
| 2006/0002743 | A1 | 1/2006 | Katsuyama et al. | |
| 2006/0002749 | A1 | 1/2006 | Katsuyama et al. | |
| 2006/0099012 | A1 | 5/2006 | Kita et al. | |
| 2007/0092303 | A1 | 4/2007 | Katsuyama et al. | |
| 2007/0122204 | A1 | 5/2007 | Kita | |
| 2007/0242984 | A1 | 10/2007 | Takami | |

FOREIGN PATENT DOCUMENTS

| | | |
|---|---|---|
| JP | 2001-315851 | 11/2001 |
| JP | 2001-324863 | 11/2001 |
| JP | 2002-072649 | 3/2002 |
| JP | 2003-255684 | 9/2003 |
| WO | WO 2004/027522 | 4/2004 |

OTHER PUBLICATIONS

U.S. Appl. No. 11/529,295, filed Sep. 29, 2006, Katsuyama, et al.
U.S. Appl. No. 11/563,844, filed Nov. 28, 2006, Kita
U.S. Appl. No. 11/931,025, filed Oct. 31, 2007, Muramatsu
U.S. Appl. No. 11/980,412, filed Oct. 31, 2007, Katsuyama et al.
U.S. Appl. No. 11/928,777, filed Oct. 30, 2007, Takami

* cited by examiner

POWDER CONTAINER HAVING A LOWER SECTION WITH MULTIPLE PARTS WHICH ROTATABLY ENGAGE WITH EACH OTHER

CROSS REFERENCE TO RELATED APPLICATIONS

The present invention is a continuation of U.S. patent application Ser. No. 10/514,832 filed Nov. 18, 2004 which is the National Stage of International Application no. PCT/JP03/11707 filed Sep. 12, 2003, the entire contents of which are incorporated herein. Additionally, the present invention claims priority to Japanese Patent Application no. 2003-028700 filed Feb. 5, 2003, Japanese Patent Application no. 2003-028718 filed Feb. 5, 2003, Japanese Patent Application no. 2002-275691 filed Sep. 20, 2002, and Japanese Patent Application no. 2002-276022 filed Sep. 20, 2002.

TECHNICAL FIELD

The present invention relates to an image forming apparatus, a powder supplying unit, a toner container, a powder container, and a reproduction a method of recycling the powder container, and more particularly, to an apparatus that stores a powder such as toner used for the image forming apparatus and reliably supplies the powder to the apparatus body, a container, and a method of recycling the powder container.

BACKGROUND ART

In a conventional forming apparatus, for example, with a two-component developing unit in which the developing unit that visualizes an electrostatic latent image formed on, for example, an image carrier, uses a toner including a toner and a carrier, since the toner is consumed with the formation of an image, it is necessary to sequentially supply the toner by the consumed amount. Therefore, in the image forming apparatus, a toner container storing the toner is provided, to supply the toner by the consumed amount from the container to the developing unit.

As the supply method of the toner from the toner container such as a toner bottle or a toner cartridge to the developing unit, a mechanical auger unit is heretofore mainly used. The toner transfer by the auger unit can control the transfer amount of the toner, but the transfer route is substantially limited to a linear route, and when the transfer route is long, coagulation of the toner may occur, thereby deteriorating the toner quality. Therefore, in the apparatus in which the toner transfer is carried out by the auger unit, the toner container should be arranged near the developing unit. Further, with the auger unit, even if the transfer distance is short, the toner cannot be raised at an acute angle. Therefore, the toner container must be arranged above the developing unit.

Patent Literatures 1 and 2 disclose a toner supplying apparatus that can considerably alleviate the problem in the conventional image forming apparatus. The toner supplying apparatus described in the Patent Literatures uses the suction force of a powder pump for the transfer of the toner. Therefore, there are advantages in that there is high flexibility in the arrangement of the toner container and toner can be supplied stably, thereby drawing much attention.

The toner container described in the Patent Literatures can be set in a setting unit in the image forming apparatus body with one action of dropping the container downward, at which time, the toner draining unit is automatically opened by a nozzle inserted in the container. When the toner container is taken out, the toner draining unit is automatically closed. This action is performed by a self-closing valve, and the self-closing valve includes a sponge in which a cross-shaped slit is formed at the center thereof. When the nozzle is inserted into the slit, the slit deforms so as to receive it, and when the nozzle is pulled out, the slit is closed due to the righting moment of the sponge to prevent the toner from spilling out of the container.

However, in the self-closing valve, the righting moment of the sponge may decrease due to curing at a low temperature, or due to a creep deformation with the lapse of time. When the righting moment decreases, the toner may leak and scatter until the slit of the self-closing valve closes, at the time of taking out the toner container.

A toner container resolving this problem is already proposed by the present applicant, and the details are shown in FIG. 21.

In a toner container 520 shown in FIG. 21, an inner shutter 560 is provided as a stopper, instead of the self-closing valve, and the inner shutter 560 includes a shutter member 561, a spring 562, a ring sealing member 563, and a spring bearing 564, and is provided in a cap member 523. The shutter member 561 is biased downward by a compression spring 562, to seal a toner draining port 524 in a state fitted to the ring sealing member 563, so that the toner does not leak outside.

As shown in FIG. 22, when the toner container 520 is set from above, a nozzle 551 is inserted while pushing the shutter member 561 upward, thereby releasing a toner drain passage.

When the toner container 520 is taken out after use, since the shutter member 561 returns to the original position in the state abutting against the nozzle 551, due to a biasing force of the spring 562, the toner leakage can be reliably prevented.

As images are formed repetitively by the image forming apparatus, the developer is consumed. Therefore, it is necessary to supply the developer by the consumed amount. For example, when the developing unit that visualizes the electrostatic latent image formed on a latent image carrier uses a two-component developer including the toner and the carrier, it is necessary to sequentially supply the toner by the consumed amount, since the toner is consumed with the image formation. Therefore, in the conventional image forming apparatus, a toner container storing the toner is provided, so as to supply the toner by the consumed amount from the toner container to the developing unit.

In the configuration in which the toner is supplied from the toner container, it is necessary to replace the empty toner container every time the toner in the toner container has been consumed. The replacement operation of the toner container is heretofore performed by a user in general.

In Patent Literature 3, a toner supplying apparatus is disclosed, in which in order to facilitate the replacement operation of the toner container by users, the toner container is set by dropping the toner container from above at the time of installation, and the toner container is lifted upward and detached at the time of detachment. In this apparatus, a self-closing valve is provided, which automatically opens only by dropping the toner container from above, and automatically closes only by lifting the toner container, in a toner draining unit, being a toner passage in the toner container. Further, the configuration thereof is simple such that a nozzle is provided in a setting unit of the image forming apparatus, and the self-closing valve provided in the toner container opens or closes by inserting or removing the nozzle.

FIG. 23 depicts a toner container 20 having a self-closing valve 201 disclosed in the Patent Literature 3. As the self-closing valve 201 of the toner container, one having a cross-shaped slit 201*a* for inserting or removing a nozzle made of a compressed foam sponge seal formed of a non-permeable material is used. The self-closing valve 201 formed of the sponge seal deforms so that when the point of the nozzle is pressed against the center of the cross-shaped slit 201*a*, the nozzle can be inserted, and when the nozzle is pulled out, the slit closes due to the righting moment of the sponge to prevent toner scattering caused by the toner spill.

Thus, by providing the self-closing valve in the toner draining unit in the toner container, the replacement operation of the toner container by the user is facilitated, and toner scattering at the time of replacement operation can be prevented to some extent.

(Patent Literature 1) Japanese Patent Application Laid-Open No. 2001-324863

(Patent Literature 2) Japanese Patent Application Laid-Open No. 2002-72649

(Patent Literature 3) Japanese Patent Application Laid-Open No. 2001-315851

However, the toner container 520 provided with the inner shutter 560 becomes an obstruction to toner discharge, since the inner shutter 560 is located above the nozzle 551 in the set state, and hence a toner bridge phenomenon in the container is likely to occur. The toner bridge in the upper part of the inner shutter 560 is hardly eliminated even by the air supplied for eliminating the toner bridge. As a result, the supply amount of the toner becomes unstable, and hence the residual amount of toner in the toner container may increase extremely.

In the self-closing valve in the Patent Literature 3, the righting moment of the sponge may decrease due to curing at a low temperature, or due to a creep deformation with the lapse of time, and when the righting moment decreases, a slight gap may be generated in the slit in the self-closing valve, at the time of taking out the toner container. When a gap is generated, in the conventional configuration in which the toner draining unit is facing the direction of gravity of the toner container, the toner may leak from the gap, drop and scatter.

When the nozzle is inserted into or pulled out from the toner container, even when the righting moment does not decrease in the material of the self-closing valve, a certain gap is generated between the self-closing valve and the nozzle. There is the possibility that the toner in the toner container leaks and scatters from this gap.

Recently, recycling of the parts constituting the container is considered for resource protection, instead of disposing the used toner container. However, with the conventional toner container, the sealing material formed of the elastic material is bonded to the body portion of the toner draining member (cap member) with an adhesive. Therefore, at the time of recycling the parts of the toner container, a complicated work for detaching the sealing material formed of the elastic material, bonded to the body portion of the toner draining member (cap member) becomes necessary, causing a problem in that recycling of the toner container is not easy.

This problem occurs likewise when a powder container for storing powder other than the toner is used.

With a view to the above problems, it is an object of the present invention to reduce toner leakage, which is likely to occur at the time of removing the toner container, without using the shutter means coming into the toner container.

It is another object of the present invention to reduce leakage of powder from a powder container at the time of setting or detaching the powder container.

It is still another object of the present invention to eliminate the shutter means coming into the toner container, to prevent a large amount of residual toner.

It is still another object of the present invention to provide a powder container, which makes recycling easy, a reproduction method thereof, a powder supplying unit, in which the powder container can be installed, and an image forming apparatus.

DISCLOSURE OF THE INVENTION

An image forming apparatus according to one aspect of the present invention includes a toner container that stores toner and supplies the toner to an image forming unit; and a setting unit that sets the toner container to a main body of the image forming apparatus, the setting unit having a nozzle coupled to a part of a toner supply path and the toner container. A fitting direction of the toner container to the setting unit and a coupling direction of the nozzle to the toner container are different.

According to the present invention, a nozzle constituting a part of a toner supply path and coupled to a toner container is provided in a setting unit, and the fitting direction of the toner container to the setting unit and the coupling direction of the nozzle to the toner container are different. Therefore, an image forming apparatus in which the residual toner in the toner container is little can be provided.

According to present invention, the setting unit includes an opening-closing folder fitted to the main body switchably between a closing position at which the toner container is in a set state and an opening position at which the toner container is in a detachable state, and the toner container is supported by the opening-closing folder.

According to the present invention, the setting unit is provided with the opening-closing folder fitted to the apparatus body movably between the closing position at which the toner container is in the set state, and the opening position at which the toner container can be detached, and the toner container is supported by the opening-closing folder. As a result, the opening and closing operation of the opening-closing folder can be used for setting or detaching the nozzle.

According to the present invention, the toner container is dropped from above and supported by the opening-closing folder in the setting unit.

According to the present invention, since the toner container is dropped from above and supported by the opening-closing folder in the setting unit, setting of the toner container can be facilitated.

The image forming apparatus according to the present invention further includes a guide member that guides the toner container dropped into the opening-closing folder to an installation position.

According to the present invention, since the guide member that guides the toner container dropped into the opening-closing folder to the installation position is provided, the dropped toner container is guided to the proper setting position, thereby reducing a setting error.

According to the present invention, the nozzle is coupled to the toner container by a shift of the opening-closing folder from the opening position to the closing position.

According to the present invention, since the nozzle is coupled to the toner container by the shift of the opening-closing folder from the opening position to the closing position, special operation for coupling the nozzle to the toner container is not necessary.

According to the present invention, the opening-closing folder is mounted on the main body rotatably between the closing position and the opening position.

According to the present invention, since the opening-closing folder is fitted to the apparatus body rotatably between the closing position and the opening position, detachment of the nozzle can be performed by using the rotation operation thereof.

According to the present invention, the opening-closing folder is mounted on the body slidably between the closing position and the opening position.

According to the present invention, since the opening-closing folder is fitted to the apparatus body slidably between the closing position and the opening position, detachment of the nozzle can be performed by using the sliding operation thereof.

The image forming apparatus according to the present invention further includes a locking unit that locks the opening-closing folder at the closing position.

According to the present invention, since the locking unit that locks the opening-closing folder at the closing position is provided, the opening-closing folder can be reliably held at the closing position.

According to the present invention, the toner container includes a storage member that stores the toner; a cap member provided below the storage member, in which a toner draining unit is formed; and a shutter member that closes the toner draining unit. The nozzle is inserted into a position of the shutter member and connected to the toner draining unit by the shift of the opening-closing folder from the opening position to the closing position.

According to the present invention, the toner container includes: a storage member that stores toner; a cap member provided below the storage member and having a toner draining unit formed therein; and a shutter member that closes the toner draining unit, wherein the nozzle is inserted into the position of the shutter member and connected to the toner draining unit, by the shift of the opening-closing folder from the opening position to the closing position. As a result, the shutter member is shifted by the insertion of the nozzle, so that the toner can be supplied.

According to the present invention, the opening-closing folder includes a returning unit that returns the shutter member shifted by insertion of the nozzle to a position to close the toner draining unit.

According to the present invention, the opening-closing folder is provided with the returning unit that returns the shutter member shifted by the insertion of the nozzle to the original position for closing the toner draining unit. Therefore, when the nozzle is pulled out from the cap member, the shutter member closes the toner draining unit, to prevent toner leakage at the time of pulling out the nozzle.

According to the present invention, the returning unit includes a slider that is slidable in a direction of shifting the shutter member; and an elasticity applying member that applies an elastic force to the slider in a direction of returning the shutter member.

According to the present invention, the returning unit includes a slider slidable in the shift direction of the shutter member, and an elasticity applying member that applies an elastic force to the slider in a direction of returning the shutter member. As a result, the shutter member can be returned to the original position by the elasticity applying member.

According to the present invention, the nozzle is slidably supported by the opening-closing folder.

According to the present invention, since the nozzle is slidably supported by the opening-closing folder, it can be prevented that the nozzle abuts against the cap member and is not connected.

According to the present invention, the nozzle is formed integrally with the slider.

According to the present invention, since the nozzle is formed integrally with the slider, such a problem that only the nozzle is pulled out and the shutter member does not return to the original position can be reliably prevented.

A powder container according to another aspect of the present invention includes a bag-like powder storage having an opening at one end; a draining port for draining the powder stored in the powder storage to outside; and a powder draining member mounted on the opening of the powder storage. At least a part of a powder passage from the powder storage to the draining port in the powder draining member is bent.

According to the present invention, since the toner passage from a bag-like container as the powder storage to the draining port is bent at one spot or more, when the bag-like container is located above the draining port, the toner in the bag-like container does not move linearly toward the draining port due to gravity.

According to the present invention, the powder draining member includes a powder passage near the opening of the powder storage, and a direction of powder passing in a portion of the drain passage near the draining port is inclined with respect to a direction of powder passing in the powder passage.

According to the present invention, the powder passing direction in the portion near the draining port is inclined with respect to the passing direction of the powder such as toner, in an inner hole as the powder passage of an external part (upper part) as a base member. Therefore, when the storage container is detached with the bag-like container located above the draining port member, the internal surface near the draining port inclines with respect to the perpendicular direction. As a result, the toner moving in the direction of gravity near the draining port can be received by the internal surface near the draining port, thereby further suppressing toner leakage from the draining port, when the storage container of toner or the like is detached.

According to the present invention, the powder storage is formed with a flexible material.

According to the present invention, since the powder storage is formed of a flexible material, after the powder storage has been used, the bag-like container can be deformed so as to decrease the volume of the powder storage (bag-like container), thereby enabling a reduction in size of the used powder container such as toner.

A powder supplying unit according to still another aspect of the present invention includes a container mounting portion on which a powder container is mounted; and a powder supplying unit that supplies powder in the powder container to an apparatus to which the powder is to be supplied. The powder container mounted on the container mounting portion includes a bag-like powder storage having an opening at one end; a draining port for draining the powder stored in the powder storage to outside; and a powder draining member mounted on the opening of the powder storage. At least a part of a powder passage from the powder storage to the draining port in the powder draining member is bent.

According to the present invention, since the powder passage from the bag-like container to the draining port is bent at one spot or more, when the bag-like container is located above the powder draining member, the powder such as toner in the bag-like container does not move linearly toward the draining port due to gravity. Further, when the bag-like container is located above the powder draining member, since at least a part of the portion from the bent portion of the powder passage to the draining port inclines with respect to the perpendicular direction, the powder moving in the direction of gravity can be received by the internal wall of the inclined portion. Therefore, when the bag-like container is located above the powder draining member, leakage of the powder such as toner from the draining port can be suppressed, when the powder container is detached.

According to the present invention, the powder supplying unit includes a powder-path forming member that forms a powder path from the powder container to the apparatus to which the powder is to be supplied; and a nozzle detaching unit that attaches or detaches a nozzle for taking in the powder in the powder-path forming member to or from a portion where the draining port of the powder container is formed.

According to the present invention, the nozzle is set to or detached from the portion where the draining port of the powder container is formed. As a result, the powder container can be easily detached.

According to the present invention, a drain passage that leads the powder from the powder storage to the draining port is formed in the powder container, and the powder container includes a shutter member that is movable between a position for opening an inlet of the drain passage on the powder storage side and a position for closing the inlet.

According to the present invention, the shutter member provided in the middle part (inner part) as the draining port member moves between the position where the inlet on the bag-like container side of a shutter hole (draining port) as the drain passage is opened and the position where the inlet is closed, thereby enabling opening or closing of the shutter hole. Therefore, toner leakage due to a decrease in the righting moment of the elastic body, which has occurred when the conventional sealing material formed of an elastic body is used, can be prevented.

According to the present invention, the drain passage is formed of a through hole opened to the outside of the powder container.

According to the present invention, since the shutter hole (draining port) as the drain passage is a through hole opened to the outside of the powder container, the shutter member is shifted by the insertion of the nozzle for draining the powder, thereby enabling automatic opening of the drain passage.

According to the present invention, the nozzle detaching unit shifts the shutter member to the position for closing the inlet of the drain passage in conjunction with a detachment operation of the nozzle, and shifts the shutter member to the position for opening the inlet of the drain passage in conjunction with the detachment operation of the nozzle.

According to the present invention, by shifting the shutter member to the position for closing the shutter hole, synchronized with detachment operation of the nozzle from the shutter hole (draining port), the shutter hole can be closed by the shutter member, even when the nozzle is detached from the shutter hole at the time of setting or detaching the powder container, thereby preventing leakage of powder such as toner and toner scattering more effectively.

According to the present invention, the shift of the shutter member to the position for closing the inlet of the drain passage is performed by a biasing force of the elastic member.

According to the present invention, the shutter member can be shifted to the closing position of the powder draining port by a resilient biasing force of, for example, a compression spring. As a result, there is no need to provide a drive for shifting the shutter member.

According to the present invention, the container mounting portion includes a powder container supporting member that movably supports the powder container between a set position where the nozzle is set to the draining port of the powder container and a detached position where the nozzle is detached from the draining port.

According to the present invention, since the opening-closing folder is provided as the powder container supporting member that movably supports the powder container between the set position where the nozzle is set to the shutter hole (draining port) of the powder container, and the detached position where the nozzle is detached from the draining port, the opening-closing folder can be used for shifting the powder container between the set position and the detached position.

According to the present invention, the powder container is dropped from above and supported by the powder container supporting member in the container mounting portion.

According to the present invention, by dropping the powder container from above, with the cap member side facing downward, the powder container can be supported at the predetermined position of the opening-closing folder (the powder container supporting member). As a result, setting of the powder container to the opening-closing folder can be performed by an easy operation of dropping the powder container.

The powder supplying unit according to the present invention further includes a guide unit that guides the powder container dropped into the powder container supporting member to a position where the nozzle is set to the draining port of the powder container.

According to the present invention, since a guide frame that guides the inserted powder container to the set position is provided in the opening-closing folder (the powder container supporting member), the dropped toner container can be guided to a position where the nozzle can be fitted to the draining port thereof by the guide frame, thereby reducing the possibility of an installation error of the powder container.

An image forming apparatus according to still another aspect of the present invention includes a developing unit that develops a latent image on an image carrier by using a powder developer; and a developer supplying unit that supplies the developer to the developing unit. As for the developer supplying unit, a powder supplying unit is used, which includes a container mounting portion on which a powder container is mounted; and a powder supplying unit that supplies powder in the powder container to an apparatus to which the powder is to be supplied. The powder container mounted on the container mounting portion includes a bag-like powder storage having an opening at one end; a draining port for draining the powder stored in the powder storage to outside; and a powder draining member mounted on the opening of the powder storage. At least a part of a powder passage from the powder storage to the draining port in the powder draining member is bent.

According to the present invention, by installing the powder supplying unit in the developing unit in the image forming apparatus, leakage of the powder from the powder container can be suppressed.

A toner container according to still another aspect of the present invention includes a storage member that stores a toner; and a cap member integrally formed with or fixed to the storage member, and having an opening for draining the toner. The opening for draining the toner includes an inner hole on the storage member side; and a shutter hole through which a shutter member can be inserted or taken out, with the inner hole and the shutter hole being communicated with each other with an angle. The opening for draining the toner is opened or closed by inserting or taking out the shutter member.

According to the present invention, the opening for draining the toner has the inner hole on the storage member side, and the shutter hole through which the shutter member can be inserted or taken out, with the inner hole and the shutter hole being communicated with each other with an angle, and the opening for draining the toner is opened or closed by inserting or taking out the shutter member. As a result, the shutter member does not go into the container, thereby preventing a large amount of residual toner.

According to the present invention, the cap member is provided in the lower part of the storage member, the inner hole is a longitudinal hole extending vertically, in the state with the cap member facing downward, and the shutter hole is a lateral hole with the axis thereof crossing the axis of the inner hole substantially at right angles.

According to the present invention, the cap member is provided in the lower part of the storage member, and the inner hole is a longitudinal hole extending vertically, in the state with the cap member facing downward, and the shutter hole is a lateral hole with the axis thereof crossing the axis of the inner hole substantially at right angles. As a result, the shutter member does not go into the container, thereby preventing a large amount of residual toner.

According to the present invention, an opening diameter of the inner hole is smaller than that of the shutter hole, in the communicating portion between the inner hole and the shutter hole.

According to the present invention, since the opening diameter of the inner hole is smaller than that of the shutter hole, in the communicating portion between the inner hole and the shutter hole, the opening for draining the toner can be reliably closed by the shutter member inserted into the shutter hole.

According to the present invention, a narrowed portion is formed in the inner hole, with the cross-sectional area of the opening decreasing toward the shutter hole.

According to the present invention, since the narrowed portion in which the cross-sectional area of the opening decreases toward the shutter hole is formed in the inner hole, the toner can be discharged smoothly and supplied.

According to the present invention, the cap member includes an upper body portion and a lower body portion. The upper body portion is provided with a storage-fixing portion to which the storage member is fixed. The lower body portion is provided with the shutter hole, and the lower body portion is formed substantially in a rectangular parallelepiped with the width between the front and back surfaces being formed thinner than the width between the opposite sides.

According to the present invention, the cap member includes the upper body portion and the lower body portion, the upper body portion is provided with the storage-fixing portion to which the storage member is fixed, the lower body portion is provided with the shutter hole, and the lower body portion is formed substantially in a rectangular parallelepiped with the width of the front and back surfaces being formed thinner than the width between the opposite sides. As a result, setting of the toner container to the proper position can be facilitated.

According to the present invention, a taper, the width of which becomes narrow toward the lower part, is formed on the opposite sides of the lower body portion.

According to the present invention, since the taper, the width of which becomes narrow toward the lower part, is formed on the opposite sides of the lower body portion, setting of the toner container to the proper position can be facilitated.

According to the present invention, the shutter hole is a through hole going through from the front surface through to the back surface of the lower body portion, and the shutter member can pass through the shutter hole.

According to the present invention, since the shutter hole is a through hole going through from the front surface through to the back surface of the lower body portion, the width of the cap member between the front and back surfaces can be made thinner.

According to the present invention, the width of the cap member between the front and back surfaces is equal to the axial width of the shutter member.

According to the present invention, since the width of the cap member between the front and back surfaces is equal to the axial width of the shutter member, there is no possibility that the shutter member obstructs installation of the toner container.

The toner container according to the present invention further includes a sealing unit that seals the shutter hole, into which the shutter member is inserted.

According to the present invention, since the sealing unit for sealing the shutter hole, into which the shutter member is inserted, is provided, toner leakage can be reliably prevented, and a toner supply path can be made a sealed passage.

According to the present invention, the shutter hole is circular in cross section, and the sealing unit is an O-ring having resilience, provided at the end of the shutter hole.

According to the present invention, since the shutter hole is circular in cross section and the sealing unit is an O-ring having resilience, provided at the end of the shutter hole, uniform sealing force can be applied over the whole circumference thereof at a reasonable cost.

According to the present invention, the sealing unit is provided in the shutter member.

According to the present invention, since the sealing unit is provided in the shutter member, it is not necessary to provide a seal holding unit in the cap member.

According to the present invention, the cap member includes a middle part having an engaging groove, with which the sealing unit is engaged; and an external part having a fitting portion to which the middle part is fitted, a storage-fixing portion to which the storage member is fixed, and a holding portion for holding the sealing unit engaged with the engaging groove.

According to the present invention, the cap member includes the middle part and the external part, the middle part is provided with the engaging groove with which the sealing unit is engaged, and the external part is provided with the fitting portion to which the middle part is fitted, the storage-fixing portion to which the storage member is fixed, and the holding portion for holding the sealing unit engaged with the engaging groove. As a result, the sealing unit can be easily assembled, and reliably held.

According to the present invention, the shutter hole is formed in the cap member, spanned over the middle part and the external part, and the cap member is assembled by inserting the shutter member into the shutter hole, with the sealing unit held by the middle part and the external part.

According to the present invention, the shutter hole is formed in the cap member, spanned over the middle part and the external part, and the cap member is assembled by inserting the shutter member into the shutter hole, with the sealing unit held by the middle part and the external part. As a result, a member or means for binding the middle part and the external part is not required.

According to the present invention, the inner hole provided in the cap member is formed, spanned over the middle part and the external part, and a narrowed portion formed in the inner hole, with the cross-sectional area of the opening decreasing toward the shutter hole, is formed in the middle part.

According to the present invention, the inner hole provided in the cap member is formed, spanned over the middle part and the external part, and the narrowed portion formed in the inner hole, with the cross-sectional area of the opening decreasing toward the shutter hole, is formed in the middle part. As a result, by detaching the middle part, the toner can be filled easily.

According to the present invention, the cap member includes an upper part having a storage-fixing portion to which the storage is fixed; an inner part having an engaging groove with which the sealing unit is engaged; and a lower part having a fitting portion to which the inner part is fitted, and a holding portion for holding the sealing unit engaged with the engaging groove.

According to the present invention, the cap member includes the upper part, the inner part, and the lower part, wherein the storage-fixing portion to which the storage is fixed is provided in the upper part, the engaging groove with which the sealing unit is engaged is provided in the inner part, and the fitting portion to which the inner part is fitted, and the holding portion for holding the sealing unit engaged with the engaging groove are provided in the lower part. As a result, the sealing unit is easily assembled and reliably held, and when the toner container is disposed, only the bag-like container and the upper part are disposed, and the inner part and the lower part can be reused.

According to the present invention, the cap member includes a coupling unit that detachably couples the upper part and the lower part. The sealing unit is held by fitting the inner part to the fitting portion in the lower part, and the cap member is assembled by coupling the lower part that holds the sealing unit by fitting of the inner part, to the upper part by the coupling unit.

According to the present invention, the cap member is provided with the coupling unit that detachably couples the upper part and the lower part, the sealing unit is held by fitting the inner part to the fitting portion in the lower part, and the cap member is assembled by coupling the lower part that holds the sealing unit by fitting of the inner part, to the upper part by the coupling unit. As a result, the assembly work is facilitated, and the assembly can be completed by the operation of one action after filling the toner.

According to the present invention, the coupling unit includes a fixed guide provided on the lower opposite sides of the upper part, and a guide support provided on the upper opposite sides of the lower part, and the fixed guide and the guide support are engaged with each other by the rotation of one of the upper part and the lower part with respect to the other thereof.

According to the present invention, the coupling unit includes the fixed guide provided on the lower opposite sides of the upper part, and the guide support provided on the upper opposite sides of the lower part, and the fixed guide and the guide support are engaged with each other by the rotation of one of the upper part and the lower part with respect to the other thereof. As a result, the assembly work is facilitated.

According to the present invention, the rotation of one of the upper part and the lower part with respect to the other thereof for allowing the engagement of the fixed guide with the guide support is a rotation about the axis of the inner hole.

According to the present invention, since the rotation of one of the upper part and the lower part with respect to the other thereof for allowing the engagement of the fixed guide with the guide support is a rotation about the axis of the inner hole, a deviation hardly occurs in the inner hole due to the coupling of the upper part and the lower part.

According to the present invention, the fixed guide and the guide support include a locking unit that locks the upper part and the lower part when the upper part and the lower part are coupled properly.

According to the present invention, since the fixed guide and the guide support are respectively provided with the locking unit that locks the upper part and the lower part when these are coupled properly, the assembly accuracy is improved, thereby preventing defective assembly.

According to the present invention, the inner hole provided in the cap member is formed, spanned over the upper part and the inner part, and a narrowed portion formed in the inner hole, with the cross-sectional area of the opening decreasing toward the shutter hole, is formed in the inner part.

According to the present invention, the inner hole provided in the cap member is formed, spanned over the upper part and the inner part, and the narrowed portion formed in the inner hole, with the cross-sectional area of the opening decreasing toward the shutter hole, is formed in the inner part. As a result, the toner can be filled easily in the state that there are no inner part and lower part.

An image forming apparatus according to still another aspect of the present invention includes a storage member that stores a toner; and a cap member integrally formed with or fixed to the storage member, and having an opening for draining the toner. The opening for draining the toner includes an inner hole on the storage member side; and a shutter hole through which a shutter member can be inserted or taken out, with the inner hole and the shutter hole being communicated with each other with an angle. When the storage member is set in a main body of the image forming apparatus, the shutter member is shifted by a nozzle provided in the main body.

According to the present invention, when the toner container having the storage member that stores toner, and the cap member integrally formed with or fixed to the storage member, and having the opening for draining the toner formed therein, in which the opening for draining the toner has the inner hole on the storage member side, and the shutter hole through which the shutter member can be inserted or taken out, with the inner hole and the shutter hole being communicated with each other with an angle, is set in the apparatus body, the shutter member is shifted by the nozzle provided in the apparatus body. Therefore, the shutter member does not go into the container, thereby providing an image forming apparatus using the toner container that prevents a large amount of residual toner.

A powder container according to still another aspect of the present invention a bag-like powder storage having an opening at one end; a draining port for draining the powder stored in the powder storage to outside; and a powder draining member mounted on the opening of the powder storage. The powder draining member includes a draining port member in which a drain passage for leading the powder from the powder storage to the draining port is formed and having a shutter function of opening or closing the drain passage; and a base member fitted to the opening, to or from which the draining port member is coupled or detached.

According to the present invention, when the use of the powder container has finished, the draining port member can be detached from the used powder container, by a simple operation of releasing the engagement of the base member constituting the opening with the draining port member. Therefore, a complicated operation of detaching the bonded elastic sealing material in the toner draining member, which is required in the conventional toner container, is not necessary. Therefore, the bag-like container as the bag-like powder storage, the base member, and the draining port member can be easily recycled as an individual part. Further, the opening communicating with the inside of the bag-like container is exposed to the outside by the detachment of the draining port member, and the powder can be filled from the exposed opening. As a result, the bag-like container can be easily recycled by refilling the toner in the bag-like container.

According to the present invention, the base member has a powder passage through which the powder from the powder storage passes, and the opening area at the outlet of the powder passage on the draining port member side is larger than that of the draining port.

According to the present invention, the opening area at the outlet of the inner hole of the external part (upper part) as the base member is larger than that of the shutter hole as the powder draining portion in the middle part (inner part) as the draining port member. Thus, since the opening area at the outlet of the inner hole of the external part (upper part) is larger than that of the shutter hole in the middle part (inner part), the powder such as toner can be easily filled from the outlet of the inner hole of the external part (upper part) exposed by detaching the middle part (inner part). Further, since the opening area of the shutter hole in the middle part (inner part) can be kept small, leakage of the powder from the shutter hole can be suppressed.

According to the present invention, the base member has a powder passage through which the powder from the powder storage passes, and the powder passage is formed such that the cross-sectional area of the powder passage in a direction of a face orthogonal to the powder passing direction decreases from the opening side of the powder storage toward the draining port member side.

According to the present invention, the cross-sectional area of the opening of the inner hole as the powder passage in the external part (upper part) as the base member, in a direction of the face orthogonal to the toner passing direction decreases from the opening side of the bag-like container as the powder storage toward the middle part (inner part) as draining port member. Thus, since a narrowed portion is formed such that the cross-sectional area of the opening of the inner hole in the external part (upper part) gradually decreases, the residual toner in the inner hole can be reduced, and the powder such as toner received from the bag-like container side can be allowed to pass smoothly toward the middle part (inner part) side.

According to the present invention, a shutter member is provided, which is movable between a position for opening the inlet of the drain passage on the powder storage side and a position for closing the inlet.

According to the present invention, since the shutter member provided in the middle part (inner part) as the draining port member moves between the position for opening the inlet of the shutter hole as the drain passage on the bag-like container side and the position for closing the inlet, the shutter hole can be opened or closed. Therefore, leakage of the powder such as toner due to a drop in the righting moment of the elastic body, which has occurred heretofore when the conventional sealing material formed of the elastic body is used, can be prevented.

According to the present invention, the drain passage is formed of a through hole opened to the outside of the powder container.

According to the present invention, since the shutter hole as the drain passage is a through hole opened to the outside of the toner container, the shutter member is shifted by inserting the nozzle for draining the toner, to automatically open the drain passage.

According to the present invention, at least a part of the powder passage from the powder storage to the draining port in the powder draining member is bent.

According to the present invention, the toner passage from the powder storage (bag-like container) to the draining port (cap member) is bent at one spot or more. Therefore, when the bag-like container is located above the cap member, the toner in the bag-like container does not move linearly toward the draining port by the gravity. Further, when the bag-like container is located above the cap member, since at least one part of the portion from the bent portion to the draining port of the passage for the powder such as toner inclines with respect to the perpendicular direction, the toner likely to move in the direction of gravity can be received by the internal wall of the inclined portion. Therefore, when the bag-like container is located above the cap member, leakage of powder such as toner from the draining port can be suppressed, at the time of setting or detaching the powder container.

According to the present invention, the base member has a powder passage through which the powder from the powder storage passes, and a direction of powder passing in a portion of the drain passage near the draining port is inclined with respect to a direction of powder passing in the powder passage.

According to the present invention, the passing direction of the powder such as toner near the draining port of the shutter hole is inclined with respect to the toner passing direction in the inner hole as the powder passage in the external part (upper part) as the base member. Therefore, when the powder container is detached in the state that the bag-like container is located above the draining port member, the internal wall of the shutter hole near the draining port is inclined with respect to the perpendicular direction. Accordingly, the toner likely to move in the direction of gravity near the draining port of the shutter hole can be received by the internal wall near the draining port of the shutter hole, and hence toner leakage from the draining port can be further suppressed at the time of setting or detaching the powder container.

According to the present invention, the powder storage is formed of a flexible material.

According to the present invention, since the powder container (bag-like container) is formed of a flexible material, after the use of the powder container has finished, the bag-like container can be deformed so as to reduce the volume thereof. As a result, the volume of the used powder container can be reduced.

A method of recycling a used powder container according to still another aspect of the present invention includes releasing an engagement of a base member with a draining port member in the used powder container to detach the draining port member from the base member; filling a powder into the powder storage from an exposed opening of the base member; and coupling the base member to the draining port member after filling the powder.

According to the present invention, when the use of the powder container has finished, the engagement between the base member and the draining port member constituting the powder draining member is released. By a simple operation of releasing the engagement of these members, the draining port member can be detached from the used powder container. Therefore, a complicated work for detaching the bonded sealing material formed of the elastic body in the powder draining member as required in the conventional powder container is not necessary. As a result, recycling of the powder storage, the base member, and the draining port member as individual parts can be facilitated. Further, the opening communicating with the inside of the powder storage is exposed to the outside by the detachment of the draining port member, and the powder can be filled from the exposed opening. As a result, the powder storage can be easily recycled by refilling the powder in the powder storage.

A method of recycling a used powder container according to still another aspect of the present invention includes releasing an engagement of a base member with a draining port member in the used powder container to detach the draining port member from the base member; and coupling another base member fitted to a powder storage filled with new powder to the draining port member.

According to the present invention, when the use of the powder container has finished, the engagement between the base member and the draining port member constituting the powder draining member is released. By a simple operation of releasing the engagement of these members, the draining port member can be detached from the used powder container. Therefore, a complicated work for detaching the bonded sealing material formed of the elastic body in the powder draining member as required in the conventional powder container is not necessary. As a result, recycling of the powder storage, the base member, and the draining port member as individual parts can be facilitated. Further, after detaching the draining port member, another base member fitted to the bag-like container filled with the new toner may be engaged with the detached draining port member to couple these members. By reproducing the toner container in this manner, the draining port member can be recycled and reused.

A powder supplying unit according to still another aspect of the present invention includes a container mounting portion on which a powder container is mounted; and a powder supplying unit that supplies powder in the powder container to an apparatus to which the powder is to be supplied.

According to the present invention, by using the powder container in, for example, a toner supplying apparatus in a color laser printer, toner leakage from a container for storing the toner can be prevented, and recycling of the toner container can be easily performed.

An image forming apparatus according to still another aspect of the present invention includes a developing unit that develops a latent image on an image carrier by using a powder developer; and a developer supplying unit that supplies the developer to the developing unit. As for the developer supplying unit, a powder supplying unit according to the above aspect is used.

According to the present invention, by using the powder container in, for example, a toner supplying apparatus in a color laser printer, toner leakage from a container for storing the toner can be prevented, and recycling of the toner container can be easily performed.

A toner container according to still another aspect of the present invention includes a bag-like toner storage having an opening at one end; a toner stored in the toner storage; a draining port for draining the toner in the toner storage to the outside; and a drain passage for leading the toner from the toner storage to the draining port. At least a part of the drain passage from the toner storage to the draining port in the powder draining member is bent.

According to the present invention, a toner cartridge can be provided, in which toner leakage from the draining port at the time of detachment is suppressed, by storing the toner used in the image forming apparatus such as a copier, in the toner storage, and guiding the toner from the toner storage to a draining port through a drain passage.

A toner container according to still another aspect of the present invention includes a bag-like toner storage having an opening at one end; a refill toner refilled in the toner storage, after the toner stored in the toner storage has been exhausted at least once; a draining port for draining the refill toner in the toner storage to the outside; and a drain passage for leading the refill toner from the toner storage to the draining port. At least a part of the drain passage from the toner storage to the draining port in the powder draining member is bent.

According to the present invention, a refill toner cartridge can be provided, in which toner leakage from the draining port at the time of detachment is suppressed, by storing the refill toner to be used in the image forming apparatus such as a copier, when the toner in the toner storage has been exhausted at least once, and guiding the refill toner from the toner storage to the draining port through the drain passage.

BRIEF DESCRIPTION OF THE DRAWINGS

FIG. 20(*b*) is a partial side view of the cap member as seen from a direction of arrow I in FIG. 20(*a*);

BEST MODE FOR CARRYING OUT THE INVENTION

[First Embodiment]

The present invention will be explained in further detail with reference to the accompanying drawings.

Figure 1:
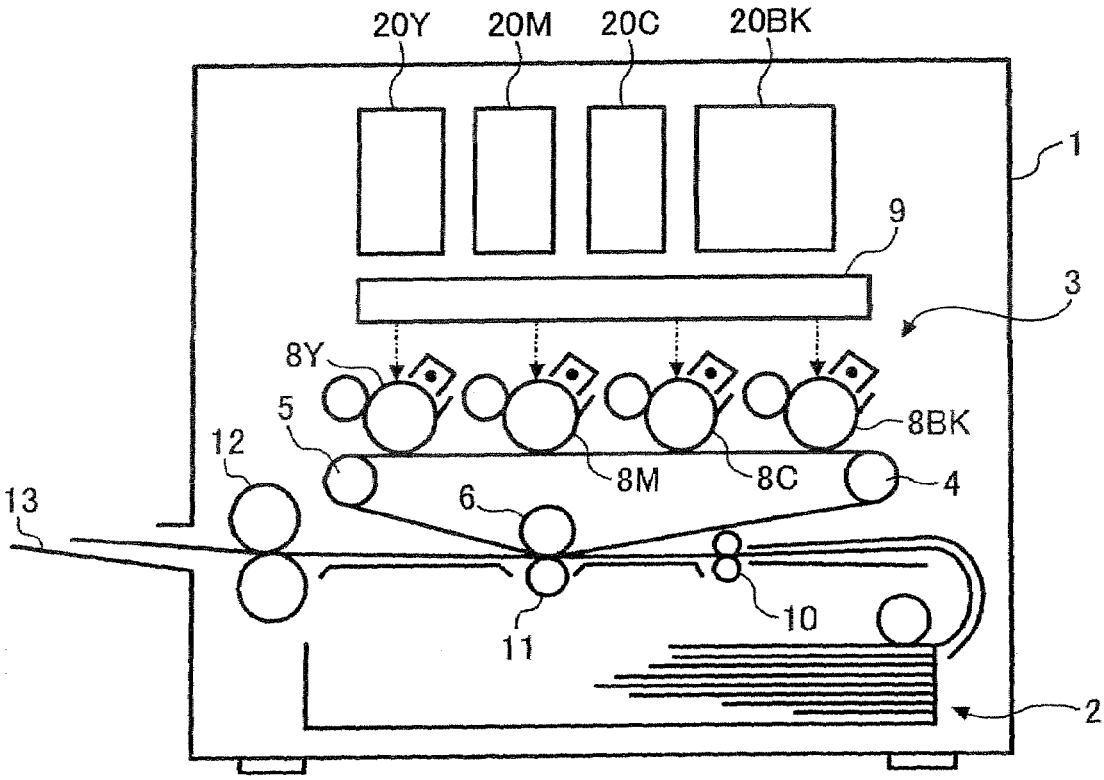
FIG. 1 is a schematic diagram of an image forming apparatus using a toner container according to the present invention.

FIG. 1 is a schematic diagram of a color laser printer, being one example of an image forming apparatus according to the present invention. The color laser printer has a configuration such that an image forming unit 3 is arranged substantially at the center of an apparatus body 1, and a paper feeder 2 is arranged below the image forming unit 3. In the image forming unit, an intermediate transfer belt 7 is provided as an image carrier formed of an endless belt having flexibility and spanned over a plurality of rollers 4, 5, and 6. In the traveling side of the upper intermediate transfer belt 7 between the rollers 4 and 5, image forming units 8Y, 8C, 8M, and 8BK as four image forming units are arranged opposite to the intermediate transfer belt 7.

The four image forming units 8 respectively include a photosensitive drum as a latent image carrier abutting against the intermediate transfer belt 7, and devices that execute the electrophotographic process such as charging, developing, and cleaning. The four image forming units 8Y, 8C, 8M, and 8BK are constructed to have the same configuration, but the color of the toner for development is different, that is, there are four colors of yellow, cyan, magenta, and black. Above the image forming unit 8, an optical writing unit 9 is arranged as an optical writing means that irradiates optically modulated laser beams onto the respective surfaces of the photosensitive drums. The optical writing unit 9 may be individually provided for each image forming unit 8; however, it is advantageous in view of the cost to use a common optical writing unit 9.

When the image forming operation is started, a toner image is formed on the photosensitive drum 10 in the respective image forming units 8 based on the electrophotographic process, and the toner image is transferred in a superimposed manner sequentially to the intermediate transfer belt 7 by a transfer unit, not shown. Thus, a full color toner image is carried on the surface of the intermediate transfer belt 7. On the other hand, a transfer material formed of paper or a resin sheet is fed by the paper feeder 2, and the transfer material is fed to the space between a secondary transfer apparatus 11 and the roller via a resist roller 10, synchronized with the timing of the toner image. At this time, a transfer voltage of an opposite polarity to the toner charging polarity of the toner image on the surface of the intermediate transfer belt is applied to the secondary transfer apparatus 11, and as a result, the full color toner image on the surface of the intermediate transfer belt is collectively transferred onto the transfer material. When the transfer material, onto which the toner image is transferred, passes a fixing apparatus 12, the toner image is dissolved due to the heat and pressure and fixed on the transfer material. The transfer material on which the image is fixed is ejected to a paper delivering unit 13 outside of the image forming apparatus body 1. Alternately, a monochrome image can be formed by using any one of the image forming unit 8, or a two- or three-colored image can be formed.

Figure 2:
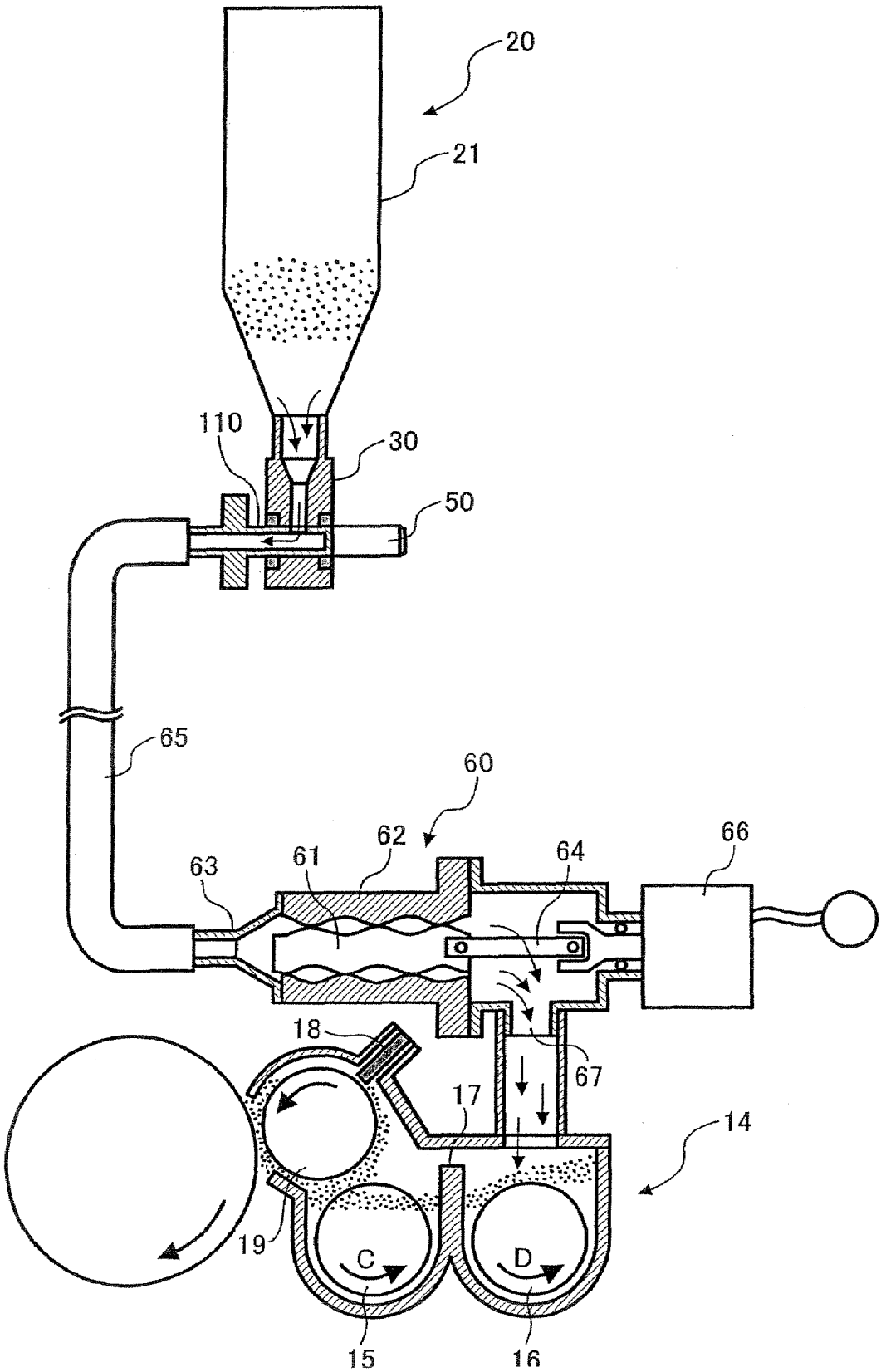
FIG. 2 is a cross section of a toner supplying apparatus in the image forming apparatus.
Figure 3:
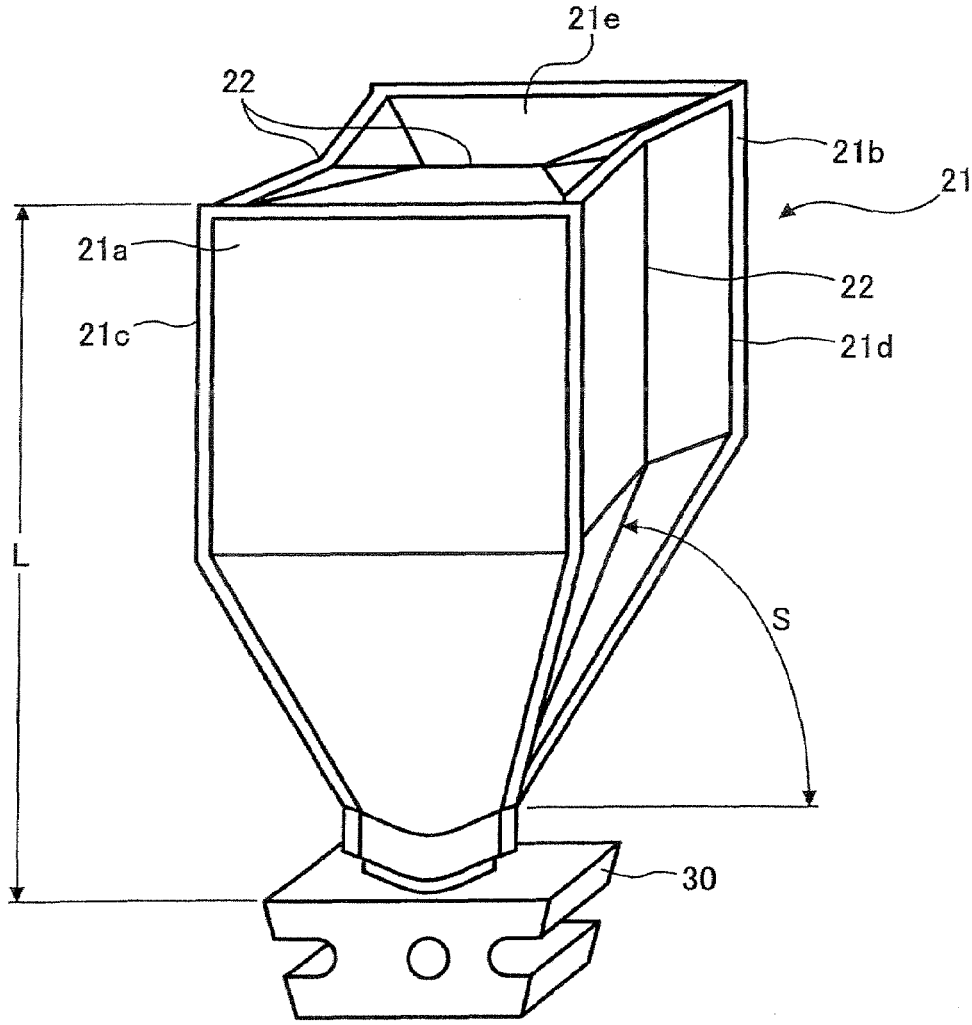
FIG. 3 is a perspective view of a state in which the toner is filled in the toner container according to the present invention.

FIG. 2 is a cross section of a toner supply mechanism in a first embodiment of the present invention. In FIG. 2, reference sign 20 denotes a toner container in which a new toner is stored as a toner, and as shown in FIGS. 2 and 3, the toner container 20 is formed of a bag-like container 21, being the toner container, and a cap member 30 having only one toner draining unit. The specific configuration of the toner container 20 will be explained later in detail.

The toner container 20 set in a printer body 1 is communicated with a developing unit 14 via a toner supply path. In the toner supply path, a nozzle 110 as a coupling member coupled to the cap member 30, a powder pump 60 as a sucking unit that transports the toner in the container to the developing unit 14 by a suction force and a toner transfer tube 65 that connects the nozzle 110 and the powder pump 60 are provided.

In the developing unit 14, screws 15 and 16 having spiral fins referred to as a transfer auger rotate in the direction of arrows C and D in the casing thereof, and a developer in which the toner and a carrier are mixed is stored therein. For example, the transfer auger is formed such that the screw 15 transfers the developer from this side to the other side in the figure, and the screw 16 transfers the developer from the other side to this side, and the developer is stirred while circulating, by providing a portion without a partition 17 at the center on the other side and this side. A part of the circulating developer is sucked up and attracted by a magnetic force of a developing roller 19, regulated to a uniform thickness by a doctor blade 18, and then comes in contact with a photoconductor. As a result, an electrostatic latent image on the photoconductor is developed by the toner to form a toner image. Only the toner adheres to the photoconductor, and development is performed, while supplying the toner thereto in a small amount from a toner supply port 68, in order to maintain the amount of the toner in the developer circulating in the developing device constant.

The powder pump 60 is a so-called monoaxial screw pump and includes two main parts, that is, a rotor 61 and a stator 62. In the rotor 61, a hard axial member, circular in cross section, is formed in spirally twisted shape, and is connected to a motor 66 via a universal joint 64. On the other hand, the stator 62 is made of a rubber-like flexible member and has a hole with the elliptical cross section being spirally twisted. The spiral pitch of the stator 62 is of a length twice as long as that of the rotor 61. By fitting these two parts to each other and rotating the rotor 61, the toner coming into a space between the rotor 61 and the stator 62 can be transferred.

When the rotor 61 in the thus configured powder pump 60 is rotated, the toner in the toner container 20 comes from a toner suction port 63 into the powder pump 60 and is sucked and transferred from left to right in the FIG. 2, and drops downward from a toner draining port 67 via the toner supply port 68. The dropped toner is supplied to the developing unit 14.

As shown in FIG. 3, the bag-like container 21 of the toner container 20 has flexibility, includes two sheets 21*a* and 21*b* constituting front and back surfaces, two sheets 21*c* and 21*d* constituting left and right sides, and an upper surface sheet 21*e*, and is formed by fusing these sheets. In the sheets 21*c* and 21*d* on the left and right sides, a fold 22 for folding inward of the container is formed, and when the toner is filled, the fold 22 expands to form the container shape, and when the container is empty, the sheets 21*c* and 21*d* are folded along the fold 22, with the front and back sheets 21*a* and 21*b* sticking or becoming adjacent to each other.

If the size of the bag-like container 21 is automatically reduced, not manually, when the bag-like container 21 becomes empty, the labor for folding the bag-like container 21 can be omitted, and advantageously, toner scattering can be prevented at the time of folding. In the toner supply mechanism, if airtightness is maintained in the toner supply path from the toner container 20 to the powder pump 60, automatic reduction can be easily realized. However, automatic reduction has problems other than keeping the airtightness. One of the problems is to make the form of the toner container 20 after reduction substantially the same. If the form after reduction is not uniform, labor for uniformalization is required, canceling the effect in automatic reduction.

The most effective method of uniformalizing the form of the toner containers 20 after reduction is to provide the fold 22. However, if the fold 22 is provided, there is a problem in that the toner is put between the front and back sheets 21*a* and 21*b*, and the folded left and right side sheets 21*c* and 21*d*, does not drop to the draining port at the lowermost position and is held halfway, and hence the toner cannot be discharged, causing residual toner.

In order to solve such a problem, it is effective to provide, in the toner container 20, a slope respectively on the front and back surfaces and the left and right sides, so that the cross-sectional area decreases toward the draining port at the bottom, and it has been found that the degree of inclination of the slope is important. It is also found that the degree of inclination is largely related to the flowability of the toner. In other words, the toner having excellent flowability moves to the draining port even if the angle of inclination is small; however a large angle of inclination is required for the toner having poor flowability.

Figure 4:
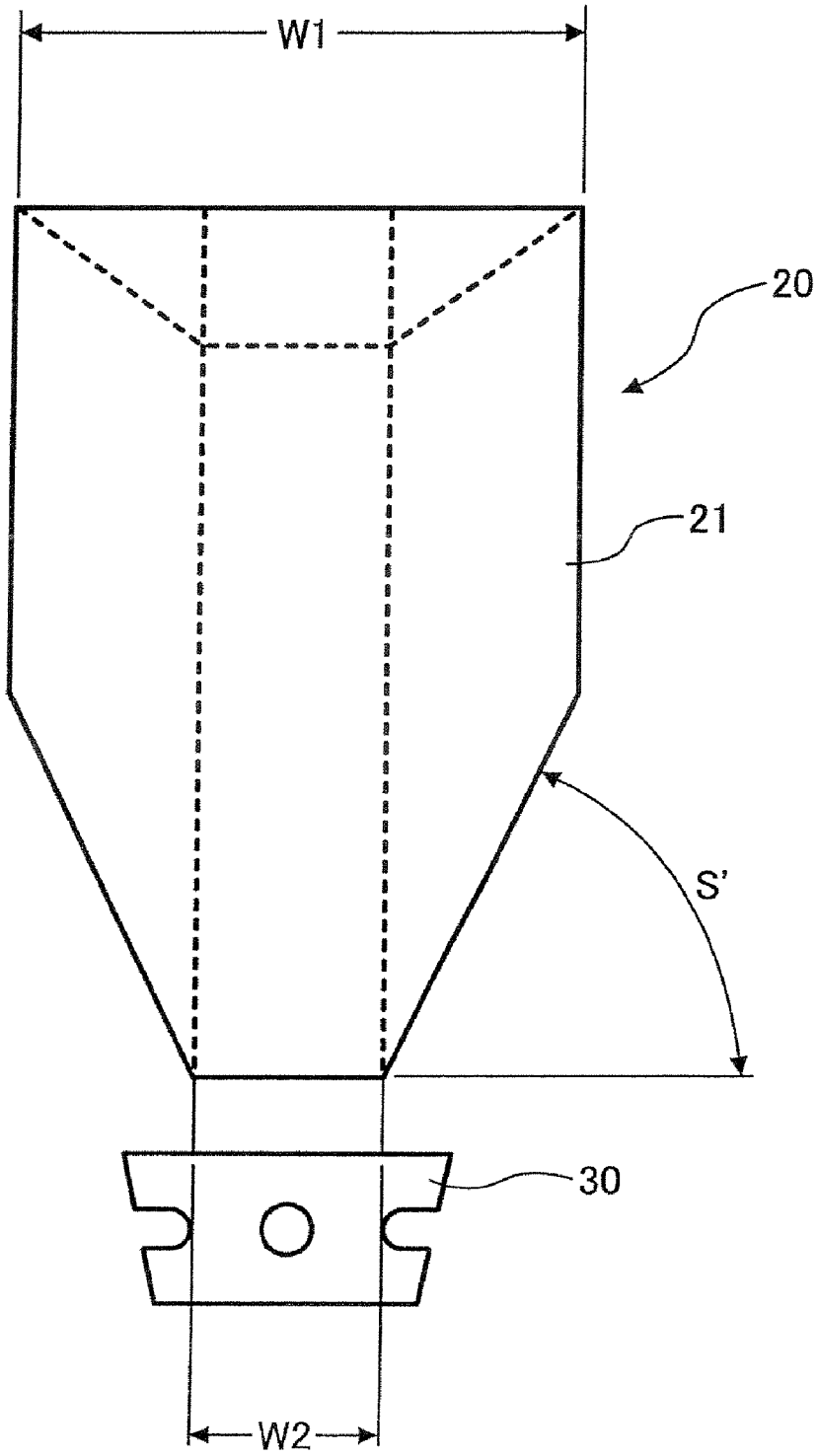
FIG. 4 is a front elevation of a state in which the toner container is folded.

Therefore, the present inventor has made an intensive study of the relation between the flowability of the toner and the angle of inclination, from an angle of repose (an angle of slope of a mountain formed by dropped powder by letting the powder freely drop in a small amount), and it has been found that the residual toner due to volume reduction can be considerably reduced by setting the angle of the slope on the sides larger than the angle of repose, when the toner container 20 is expanded. In other words, it is effective to set an angle S shown in FIG. 3 larger than the angle of repose of the toner, and the angle S has a relation of:

$$S' = \mathrm{Tan}^{-1}(1/\cos\phi),$$

where $\phi$ denotes the angle of repose of the toner, and S' is an angle of a weld on the side in the state that the toner container 20 shown in FIG. 4 is folded. For example, when the angle of repose of the toner is 40°, $$S' = \mathrm{Tan}^{-1}(1/\cos 40) = 52.55°,$$

and when the weld is formed at an angle of 52.55° or more, the angle S in the expanded state becomes 40° or more. The angle of repose of the toner "imagio toner type 15", produced by Ricoh Company, Ltd., is 30.5°, and according to the above equation, S' becomes 49.3°. However, since the toner tends to deteriorate in flowability according to the environment (temperature, humidity, and the like), it is preferable to set the angle S' larger than that by 2 to 5°. Considering only the residual toner, the angle S' may be set to an angle as large as, for example, 60° or more. However, when the angle S' is set large, the stored amount of the toner per unit area occupied by the container decreases. Therefore, it is preferable that the angle of the slope on the sides when the toner container 20 is expanded slightly exceeds the angle of repose of the toner.

Figure 5:
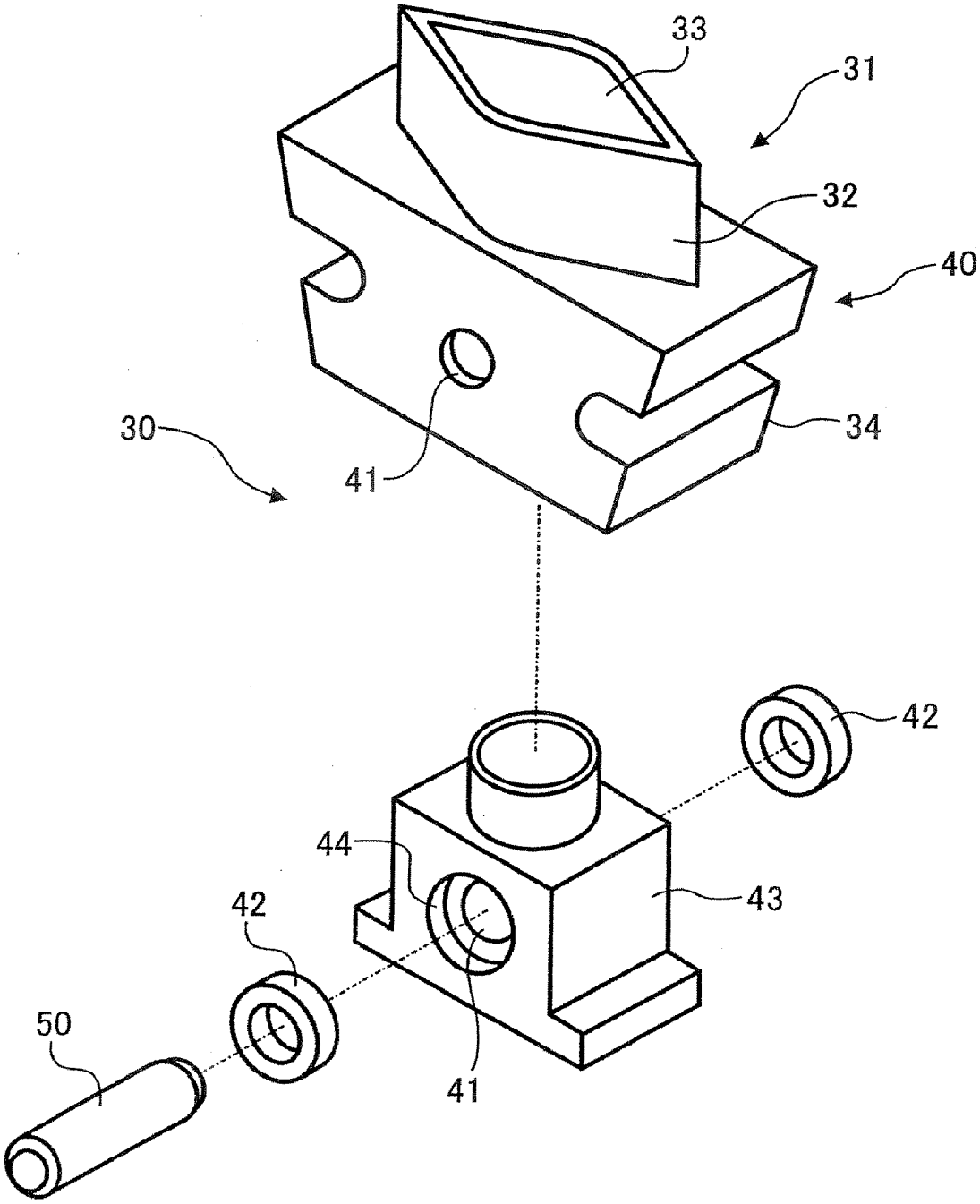
FIG. 5 is an exploded perspective view of one embodiment of a cap member of the toner container according to the present invention.
Figure 6:
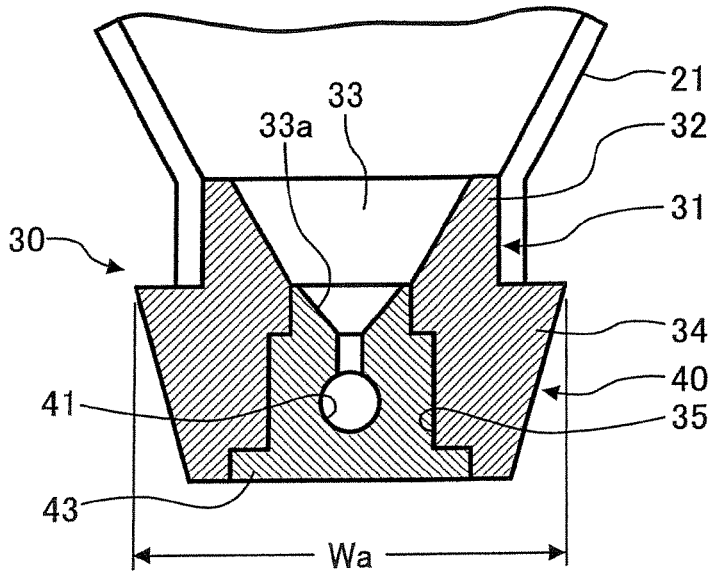
FIG. 6 is a cross section of the cap member in FIG. 5.
Figure 7:
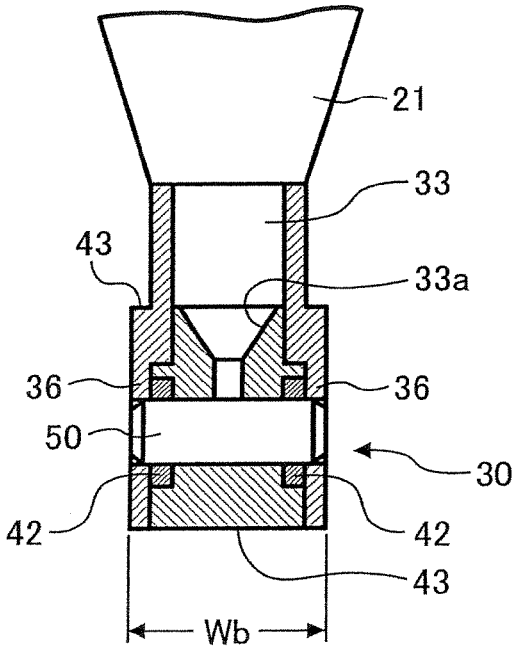
FIG. 7 is a longitudinal cross section of the cap member in FIG. 5.

As shown in FIGS. 5 to 7, the cap member 30 includes an upper body portion 31 and a lower body portion 40, and a storage-fixing portion 32 is provided in the upper body portion 31, to which the bag-like container 21 formed in a boat shape as seen from above is welded. The lower body portion 40 is substantially in a rectangular parallelepiped, and when it is assumed that the surface shown in FIG. 5 is the front surface, a width Wa of front and back surfaces in the lower body portion 40 of the cap member 30 is set wider than a width Wb on the opposite sides.

In the cap member 30, an opening for draining the toner is formed, which includes an inner hole 33 on the bag-like member 21 side and a shutter hole 41 communicated to the inner hole 33, through which a shutter member described later can be inserted or pulled out. The inner hole 33 is a longitudinal hole extending in the vertical direction, with the cap member 30 facing downward, whereas the shutter hole 41 is a lateral hole, whose axis crosses the axis of the inner hole 33 substantially at right angles, and the shutter hole 41 in the present embodiment is a through hole circular in cross section going through from the front surface to the back face in the lower body portion 40. The inner hole 33 is a hole circular in cross section, designating the length in a minor direction inside of the storage-fixing portion 32 having a boat shape as a diameter, and includes a funnel-shaped narrowed portion 33*a* formed halfway therein. That is, the inner hole 33 has a reduced diameter halfway by the narrowed portion 33*a* so that the opening area decreases toward the shutter hole 41, and is communicated with the shutter hole 41 above thereof. Therefore, in a communicating portion between the inner hole 33 and the shutter hole 41, the opening diameter of the inner hole 33 becomes smaller than that of the shutter hole 41. When a shutter member 50 is inserted in the shutter hole 41, the opening for draining the toner is reliably closed.

The shutter member 50 in the embodiment is formed in a circular shaft shape in cross section, and is formed to have a smaller diameter than that of the shutter hole 41. As a result, the shutter member 50 can be reliably inserted in the shutter hole 41. However if the diameter of the shutter member 50 is smaller than that of the shutter hole 41, leakage of toner or air occurs from between the shutter member 50 and the shutter hole 41. The toner leakage causes toner contamination and air leakage obstructs volume reduction of the toner container 20.

Figure 8:
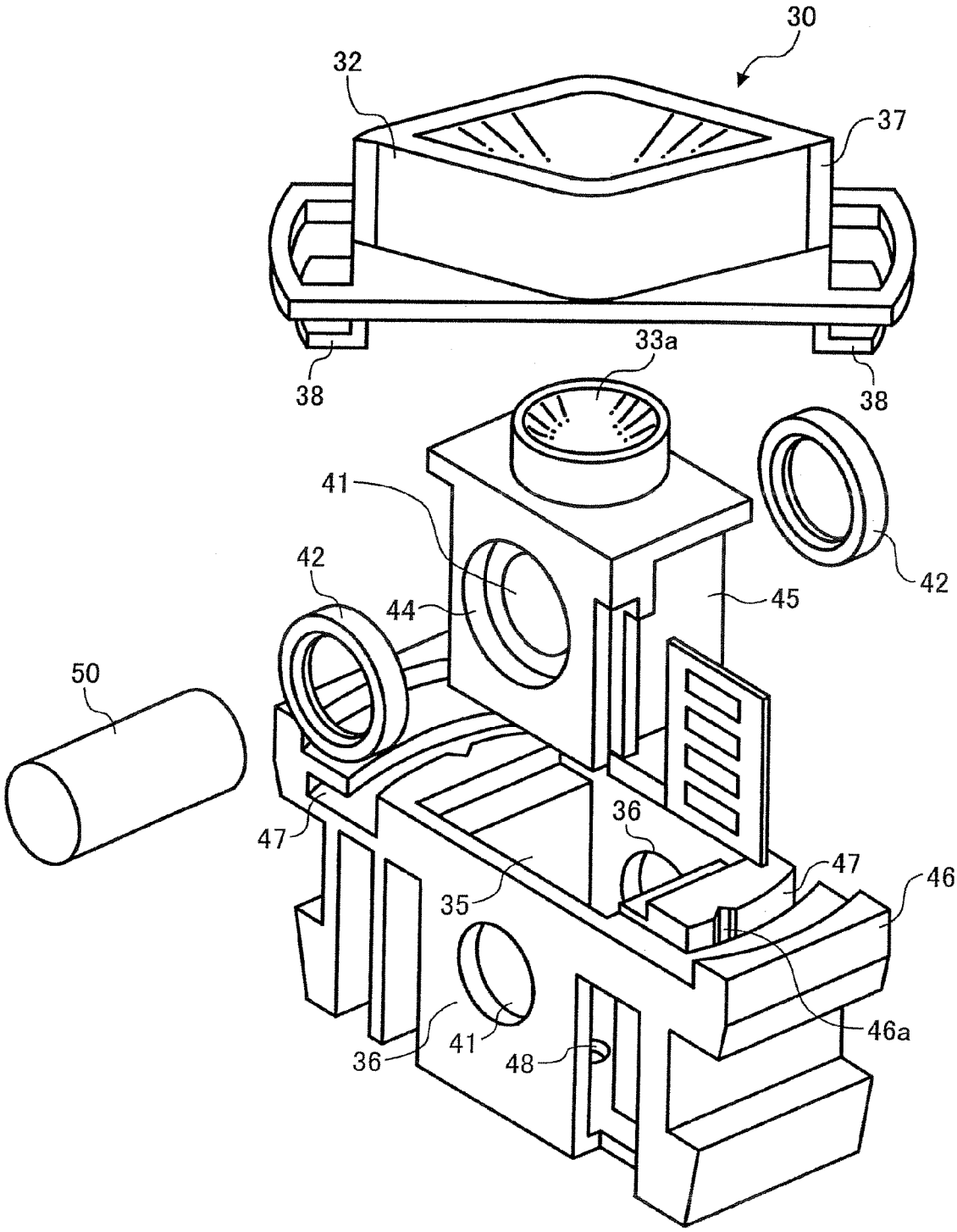
FIG. 8 is an exploded perspective view of another configurational example of the cap member of the toner container according to the present invention.

In the cap member 30, as shown in FIG. 8, an O-ring 42 pentagonal in cross section is provided as a sealing unit that seals between the cap member 30 and the shutter member 50. Since, the shutter hole 41 is a through hole, the O-ring 42 is provided on the opposite sides of the shutter hole 41. The O-ring 42 may be fitted by forming a groove, in which the O-ring 42 is fitted, on the opposite sides of the shutter hole 41 and fixing by bonding. However, time and labor are required for fixing the O-ring 42, thereby causing a problem in that the assembly cost increases.

Therefore, the cap member 30 in the embodiment shown in FIGS. 5 to 7 is divided into a middle part 43 and an external part 34, and the O-ring 42 is held by engagement of these parts. Specifically, the middle part 43 is provided with an engaging groove 44 through which the O-ring 42 is connected to the middle part 43, and the external part 34 is provided with a fitting portion 35 to which the middle part 43 is fitted, the storage-fixing portion 32, a holding portion 36 for holding the O-ring 42 engaged with the engaging groove 44. When the middle part 43 is fitted to the external part 34 via the O-ring 42, with the O-ring 42 engaged with the engaging groove 44, the O-ring is pressed by the holding portion 36, thereby reliably preventing the O-ring 42 from coming off.

The shutter hole 41 is formed across the middle part 43 and the external part 34. The middle part 43 is fitted to the fitting portion 35 of the external part 34, and the shutter member 50 is inserted in the shutter hole 41, thereby attaching the meddle part 43 to the external part 34. By a simple operation of pulling out the shutter member 50, the cap member 30 can be disassembled into the external part 34 and the middle part 43. Since the toner spills when the shutter member 50 is pulled out in the state with the toner filled in the toner container 20, the diameter thereof is suppressed to about 8 mm at most, and the diameter is preferably 6 mm, since the shutter member 50 is hardly moved by a finger with this size of diameter. In other words, if it is assumed that the diameter of the shutter member 50 is 10 mm, there is the possibility that the shutter member 50 is moved by a finger of an adult, thereby causing toner leakage. Therefore, the diameter of the shutter member 50 is set to 8 mm or less.

Figure 9:
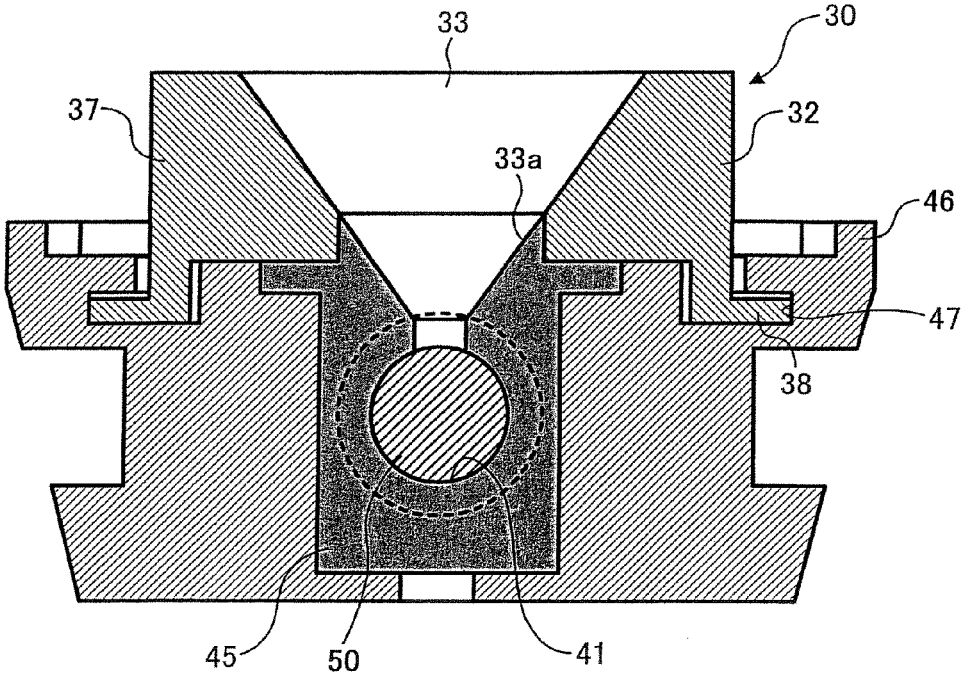
FIG. 9 is a cross section of the cap member in FIG. 8.
Figure 10:
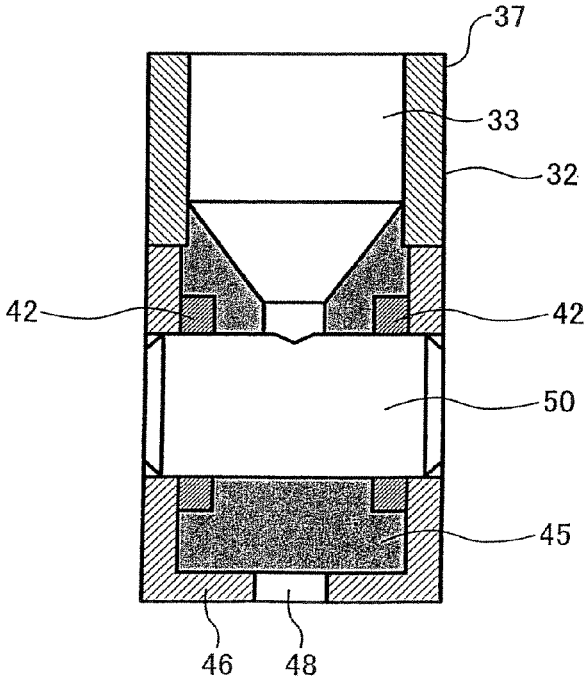
FIG. 10 is a longitudinal cross section of the cap member in FIG. 8.

FIGS. 8 to 10 are exploded perspective views of another configurational example of the cap member 30, and the cap member 30 in the present embodiment is formed of three parts of an upper part 37, an inner part 45, and a lower part 46. The upper part 37 is provided with the storage-fixing portion 32 to which the bag-like member 21 is fixed and a fixed guide 38 as an engaging means that engages with the lower part. The inner part 45 is provided with the engaging groove 44 with which the O-ring 42 is engaged, and the fitting portion 35 for the inner part 45, the holding portion 36 for the O-ring 42, and a guide support 47 for the fixed guide 38 in the upper part 37 are provided in the lower part 46.

In the cap member 30, the shutter hole 41 is formed across the inner part 45 and the lower part 46, and the inner part 45 in which the O-ring 42 is engaged with the engaging grove 44 is fitted to the fitting portion 35 in the lower part 46, and by inserting the shutter member 50 in the shutter hole 41, the inner part 45 is attached to the lower part 46. The upper part 37 and the lower part 46 are couple to each other by rotating the fixed guide 38 in the upper part 37 so as to fit to the guide support 47, thereby completing the assembly of the cap member 30. At this time, the cap member 30 is provided with a locking unit that is locked when the upper part 37 and the lower part 46 are coupled to each other at the proper position. The locking unit in the present embodiment includes a locking claw (not shown) provided in the upper part 37 and a locking groove 46*a* provided in the lower part 46, and when these parts are coupled to each other at the right position, the locking claw fits into the locking groove 46*a*. The inner hole 33 is formed across the upper part 37 and the inner part 45. Since the upper part 37 and the lower part 46 are coupled to each other by the rotation operation about the axis of the inner hole 33, the inner hole 33 is not deviated.

In the cap member 30 in the embodiment, with two parts, the inner hole 33 extends over the external part 34 and the middle part 43, and with three parts, the inner hole 33 extends over the upper part 34 and the inner part 43. The funnel-shaped narrowed portion 33*a* is formed in the inner hole 33, and in the both embodiments, the funnel-shaped narrowed portion 33*a* is formed in the middle part 43 and the inner part 45, being the inside part.

The toner is filled in the toner container 20 in a factory, however, in the toner container 20, it is difficult to fill the toner from the shutter hole 41, since it is via the inner hole 33 facing a different direction. Further, filling by forming a filling opening in the bag-like container 21 itself, and by using this opening is also difficult, because the container expands due to the filled toner, and hence sealing of the container is difficult. Therefore, in the toner container 20 in the above two embodiments, before the middle part 34 or the inner part 45 is fitted, the inner hole 33 is a relatively large opening, because the narrowed portion 33*a* is not formed in the inner hole 33.

Therefore, if the toner is filled before the middle part 34 or the inner part 45 is fitted, the filling operation can be easily conducted, and thereafter, by fitting the middle part 34 or the inner part 45, the container becomes the sealed state. Thus, if the cap member 30 is formed of the two parts or the three parts, filling of the toner becomes easy.

The toner container 20 using the two-part cap member 30 requires two actions of fitting the middle part 43 to the external part 34 after filling the toner, and inserting the shutter member 50 therein. However, with the toner container 20 using the three-part cap member 30, by fitting the inner part 45 to the lower part 46, and inserting the shutter member 50 therein beforehand, only one action of coupling the lower part 46 to the upper part 37 is required after filling the toner, and hence it is more preferable.

The configuration of the fitting portion of the toner container 20 having the above configuration to the image forming apparatus body 1 will be explained.

Figure 11:
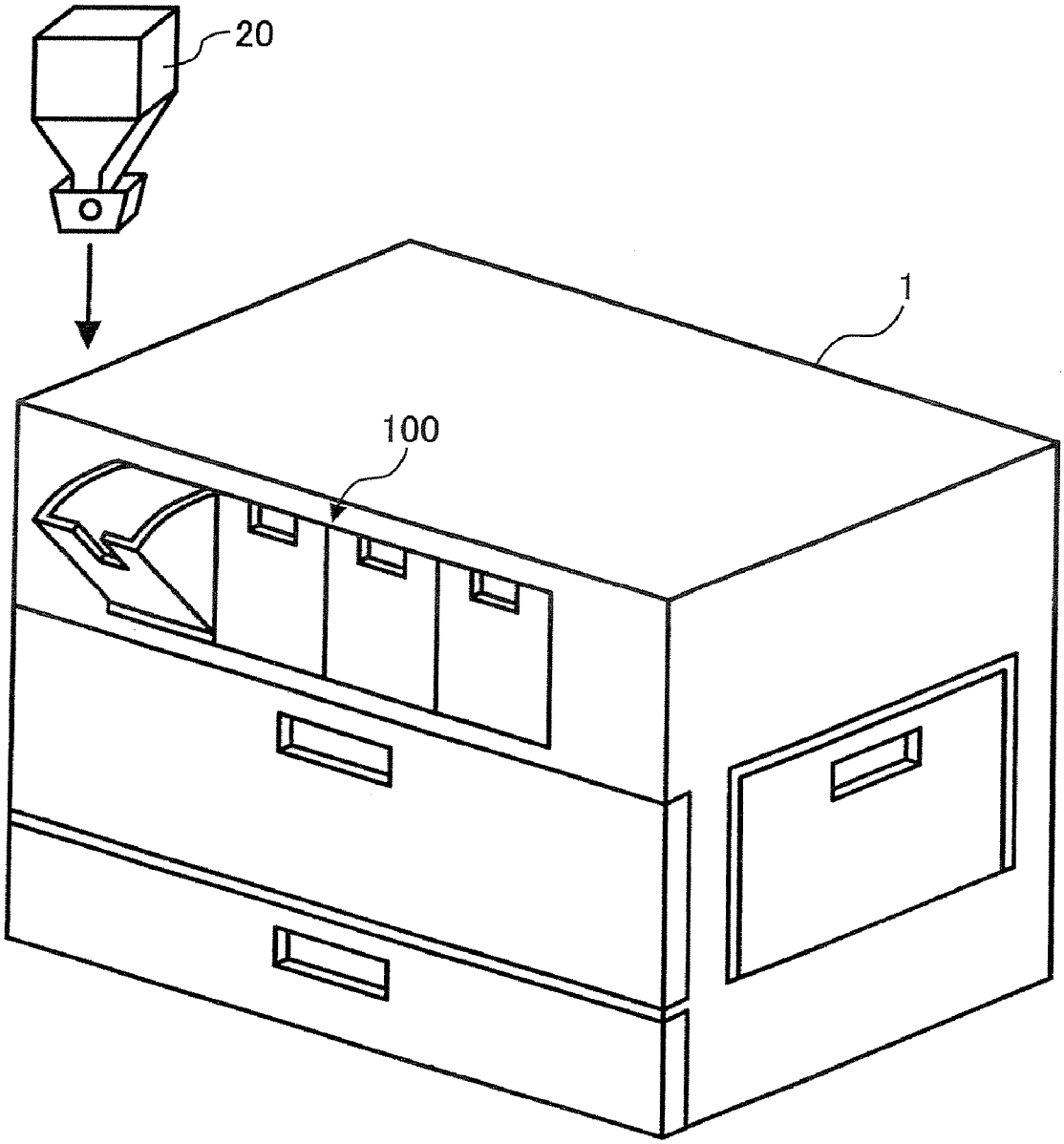
FIG. 11 is an outline view of the image forming apparatus shown in FIG. 1.
Figure 12:
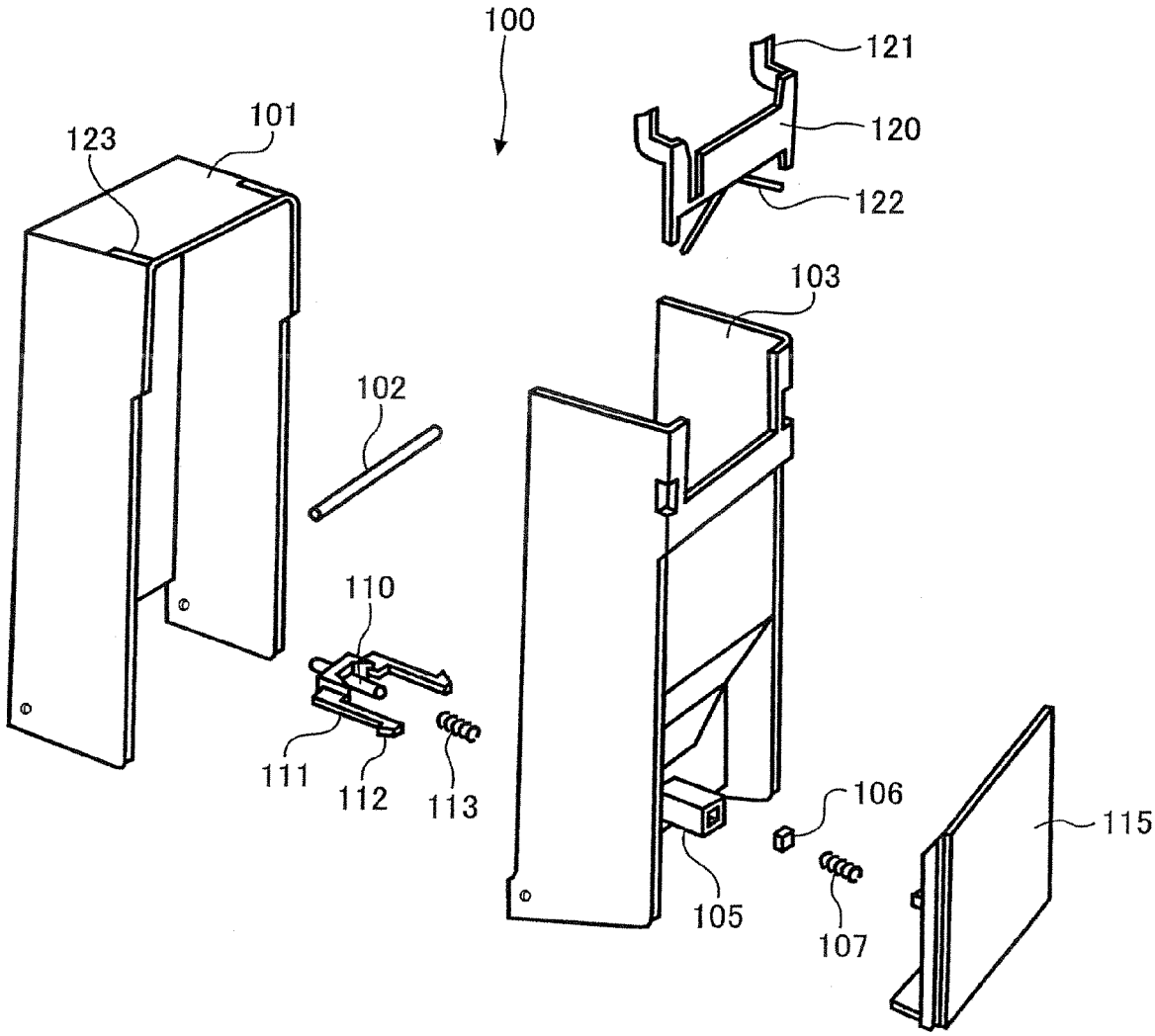
FIG. 12 is an exploded perspective view of a setting unit of the toner container.
Figure 13:
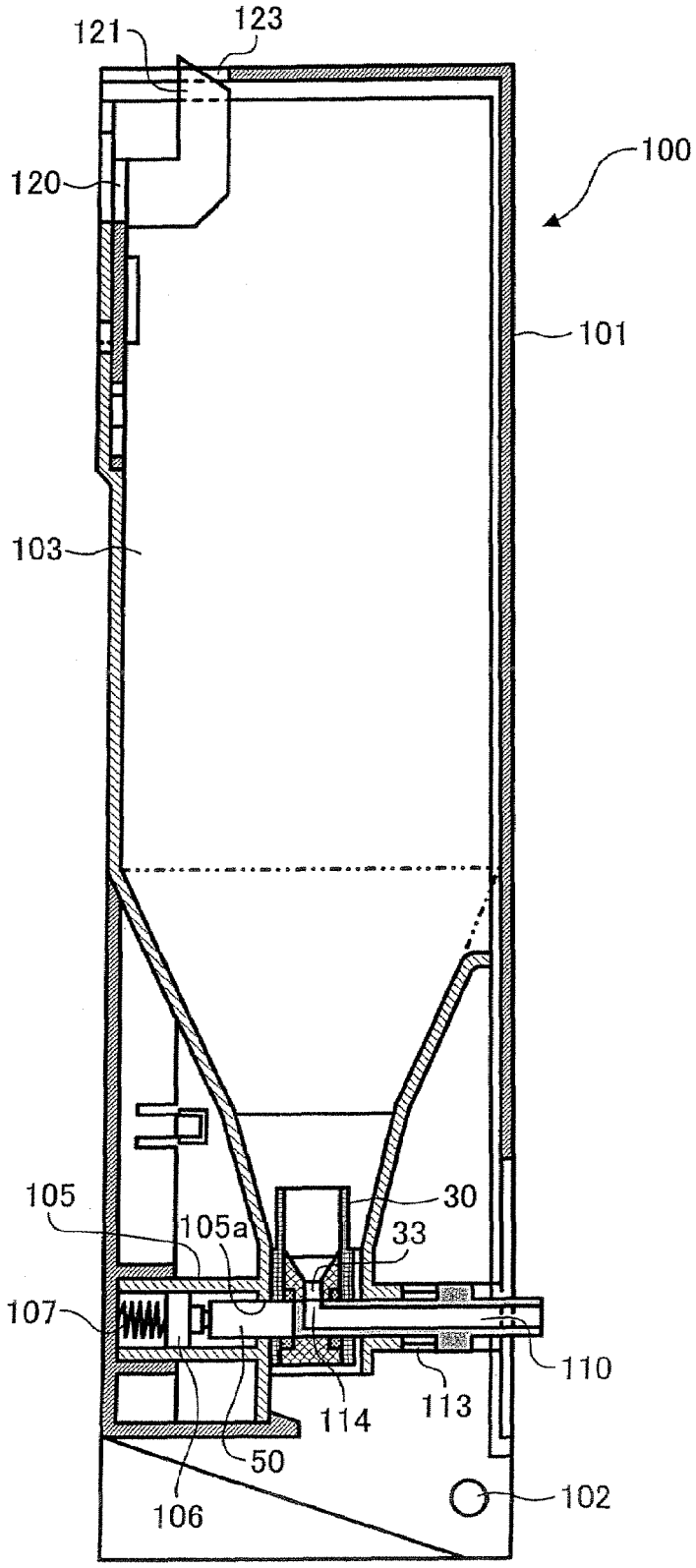
FIG. 13 is a cross section of a state in which an opening-closing folder of the setting unit shown in FIG. 12 is closed.

In the image forming apparatus in the embodiment, as shown in FIG. 11, setting units 100 to which the toner containers 20 for the four color toners are respectively fitted are provided. Only the setting unit 100 for black is formed in a wider size than that of other setting units, but the internal configuration is substantially the same. As shown in FIGS. 12 and 13, an opening-closing folder 103 fitted to a machine frame 101 of the apparatus body via a rotation shaft 102 is provided in the setting unit 100, and the opening-closing folder 103 is rotatably supported by machine frame 101 between a closing position shown in FIG. 13 and an opening position shown in FIG. 14. In the lower part of the opening-closing folder 103 are formed, as shown in FIG. 15, a pair of guide members 104 that slidably support the nozzle 110, and a guide cylinder 105 to which a slider 106 that returns the inserted nozzle 110 is slidably fitted, and a fixed cover 115 is fitted on the outer surface thereof. In the upper part of the opening-closing folder 103, an opening and closing handle 120 is installed movably in the vertical direction, which is provided with a locking unit 121 that holds the opening-closing folder 103 at the closing position, when the opening-closing folder 103 is shifted to the closing position. The opening and closing handle 120 is made of resin, and has an integrally formed resilient arm 122 below the handle 120. The opening and closing handle 120 is held at the uppermost position by the resilient arm 122 at all times. The nozzle 110 is formed in the same diameter as that of the shutter member 50.

On the nozzle 110, an integrally formed slide arm 111 is respectively provided on the opposite sides thereof, and the slide arm 111 is movably fitted to the guide member 104. At the point of the slide arm 111, a locking claw 112 is provided, and the locking claw 112 is locked at the end of the guide member 104, thereby preventing the nozzle 110 from coming off from the opening-closing folder 103. Further, a compression spring 113 is fitted loosely so as to wrap around the nozzle 110 between the nozzle 110 and the opening-closing folder 103. By this spring 113, the nozzle 110 is held with resiliency at all times, at a position where the locking claw 112 is locked at the end of the guide member 104.

The guide cylinder 105 has a cylindrical shape extending on the axis of the nozzle 110, and a hole 105*a* into which the shutter member 50 can be inserted is formed at the end opposite to the nozzle 110. The opposite end is closed by the fixed cover 115. The slider 106 and the compression spring 107 that pushes the slider 106 toward the nozzle 110 are enclosed in the guide cylinder 105. The slider 106 is formed in a convex shape in cross section, and is held within the guide cylinder 105 by a stopper 108 formed at the end on the nozzle side of the guide cylinder 105, even when the slider 106 is pushed by the compression spring 107. The opening-closing folder 103 is provided with a guide frame 109 that leads the inserted toner container 20 to the set position, and the nozzle 110 is arranged at the lowermost part of the guide frame 109, thereby forming a support to which the lower body portion 40 of the cap member 30 of the toner container 20 is fitted. An opening, not shown, through which the nozzle 110 and the shutter member 50 can pass is formed in the support.

Figure 14:
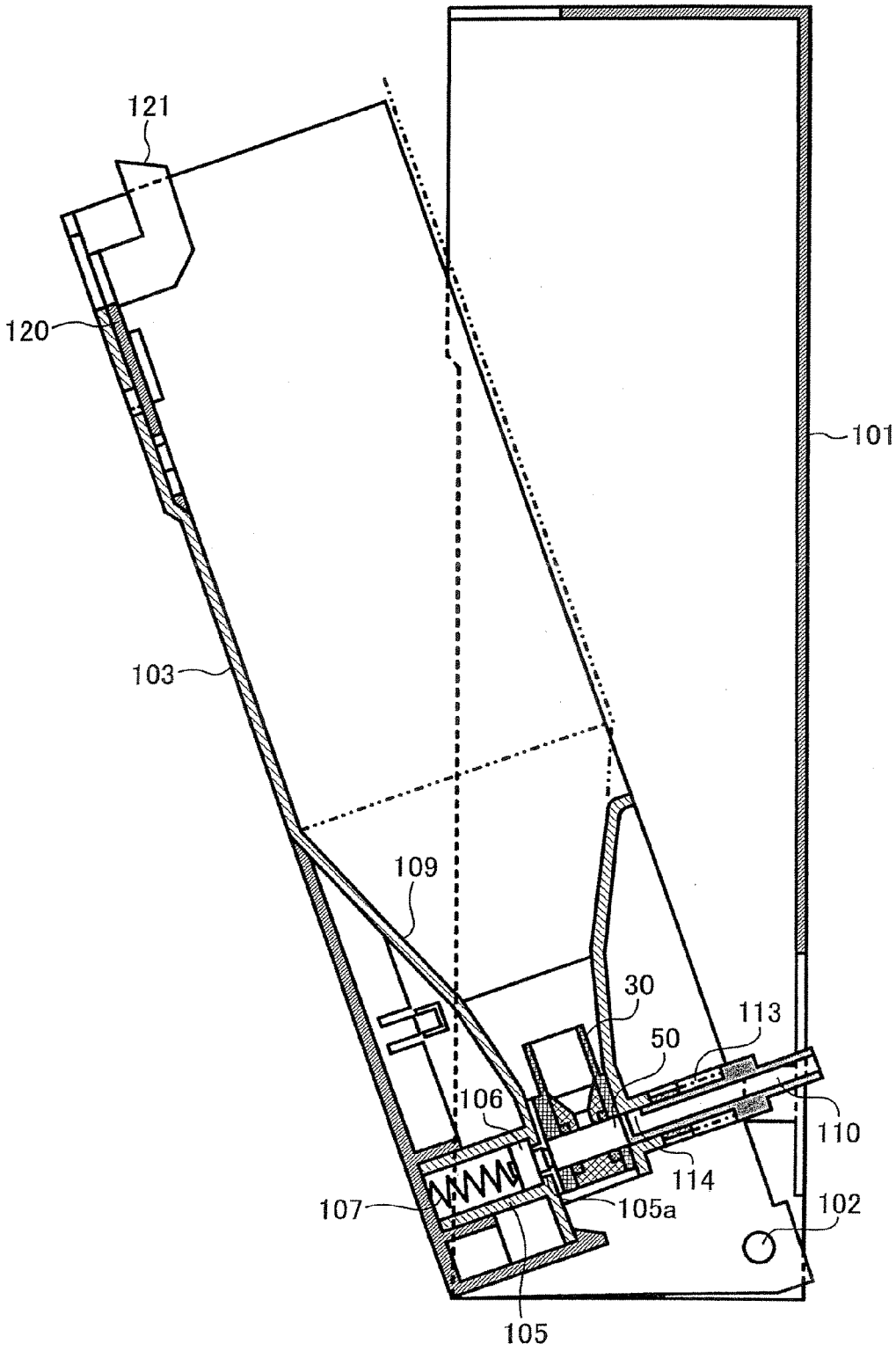
FIG. 14 is a cross section of a state in which the opening-closing folder of the setting unit shown in FIG. 12 is opened.
Figure 15:
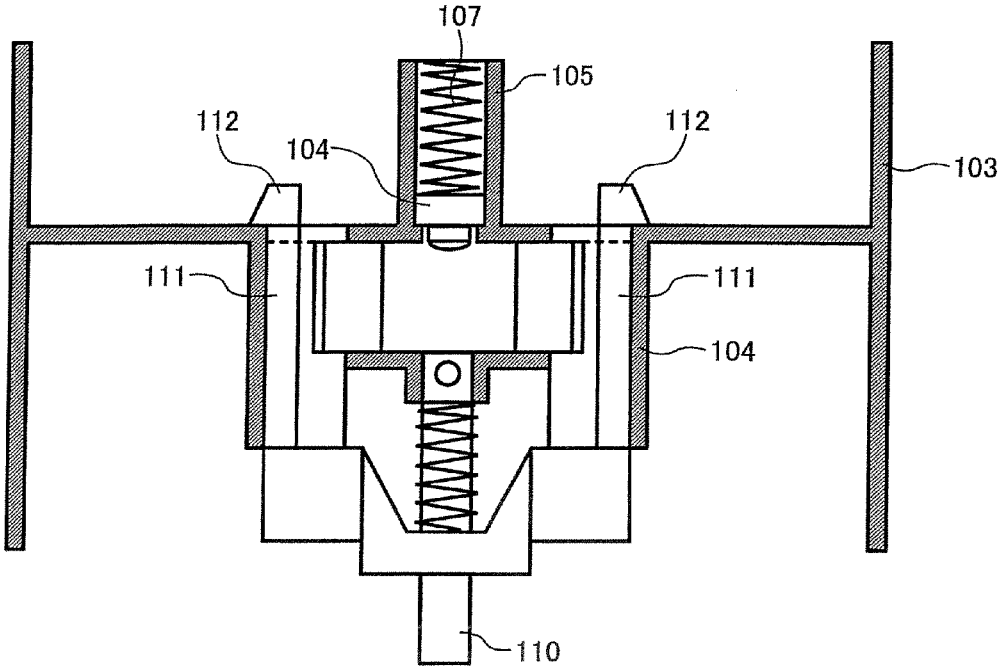
FIG. 15 is a lateral cross section of the setting unit shown in FIG. 12.

In the thus configured setting unit 100, when the opening and closing handle 120 is pulled forward while being pushed down, the locking unit 121 comes off from the locking groove 123 formed in the machine frame 101, and hence, as shown in FIG. 14, the bottom of the opening-closing folder 103 can be rotated about the rotation shaft 102 up to the position where the bottom of the opening-closing folder 103 abuts against the machine frame 101, so that the opening-closing folder 103 is shifted to the opening position. The opening-closing folder 103 at the opening position is in the state that the nozzle 110 is pulled to the left side in FIG. 14. Here, when the toner container 20 is dropped with the cap member 30 side facing downward, since the nozzle 110 is held at a position where the engaging claw 112 abuts against the guide member 104 by the compression spring 113, the shutter member 50 in the cap member 30 drops to a position opposite to the nozzle 110.

After the toner container 20 is dropped to a predetermined position, the opening-closing folder 103 is returned to the original closing position shown in FIG. 13. By this returning action, the nozzle 110 is fitted into the shutter hole 41, and the shutter member 50 is shifted from the hole 105*a* toward the guide cylinder 105. A toner receiving port 114 is provided on the nozzle 110, on the upper part of the periphery thereof near the end, and the toner receiving port 114 communicates with the lower part of the inner hole 33 provided in the cap member 30, thereby forming a toner supply path from the toner container 20 to the developing unit 14.

The shutter member 50 pushed out toward the guide cylinder 105 by the insertion of the nozzle 110 is held at a position spanning over the shutter hole 41 and the guide cylinder 105, without coming off completely from the shutter hole 41.

When the nozzle 110 is inserted in the shutter hole 41, the compression spring 113 is pushed by the opening-closing folder 103 and compressed, and the compression spring 107 provided in the guide cylinder 105 is also compressed via the slider 106 by the insertion of the shutter member 50. Therefore, when the opening-closing folder 103 is shifted from the closing position to the opening position, the nozzle 100 and the shutter member 50 are returned to the original position, respectively, by the resilient force of the compression spring 113 and the compression spring 107. As a result, the nozzle 110 comes off from the shutter hole 41 in the toner container 20, and the shutter member 50 is again inserted in the shutter hole 41.

Only by setting the toner container 20 in the apparatus body 1, the toner container 20 communicates with the toner supply path, and when the opening-closing folder 103 is opened, the nozzle 110 comes off from the shutter hole 41. At this time, however, since the shutter member 50 is returned to the shutter hole 41 immediately, the toner does not leak from the toner container 20.

Figure 16:
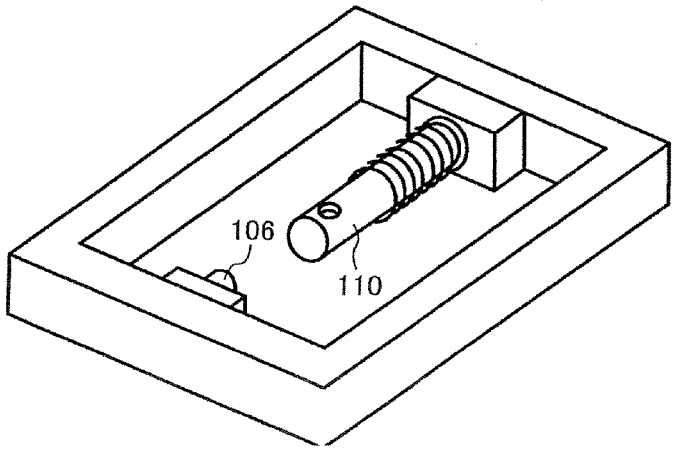
FIG. 16 is a perspective view of an embodiment in which a nozzle and a slider are integrally formed.

In the embodiment, at the time of setting the toner container 20, the nozzle 110 and the slider 106 are shifted in the same direction by the same amount. Therefore, as shown in FIG. 16, the nozzle 110 and the slider 106 may be integrally formed. This configuration can avoid such a problem that even if the nozzle 110 is pulled out, the slider 106 does not move, and hence, the shutter member 50 does not close the shutter hole 41.

Figure 17:
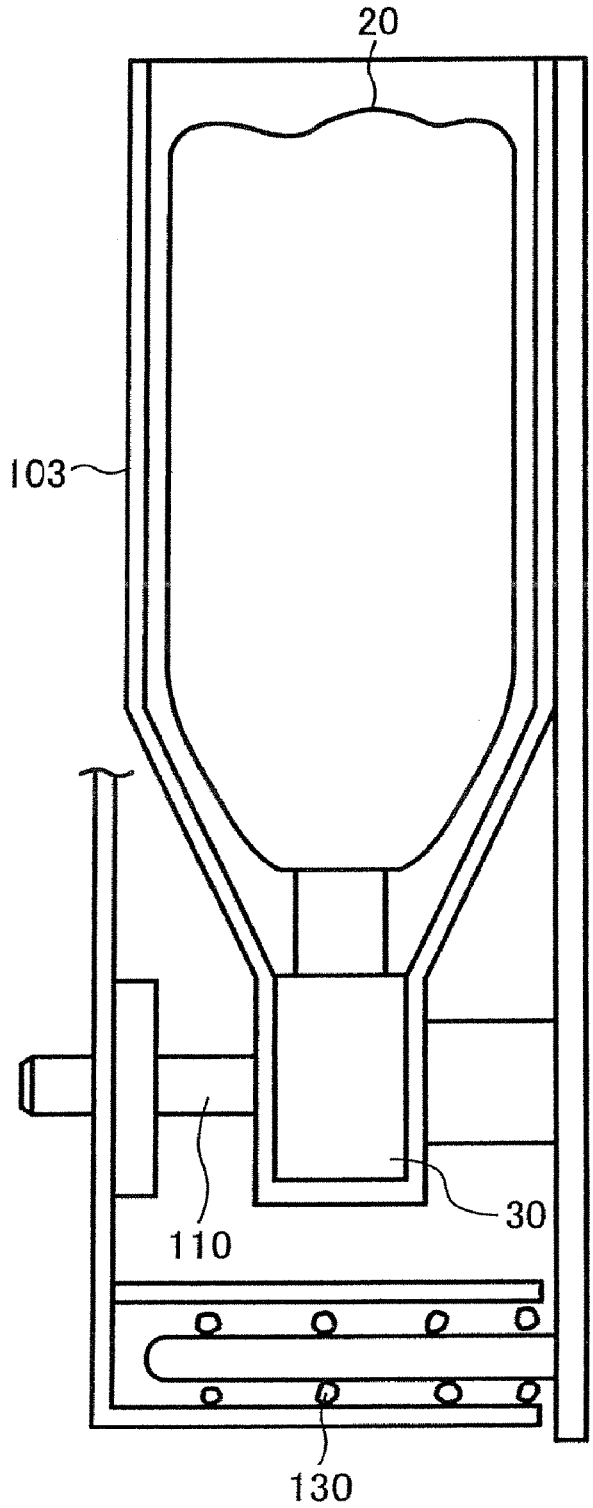
FIG. 17 is an explanatory diagram of another embodiment of the setting unit of the toner container in the closed state.
Figure 18:
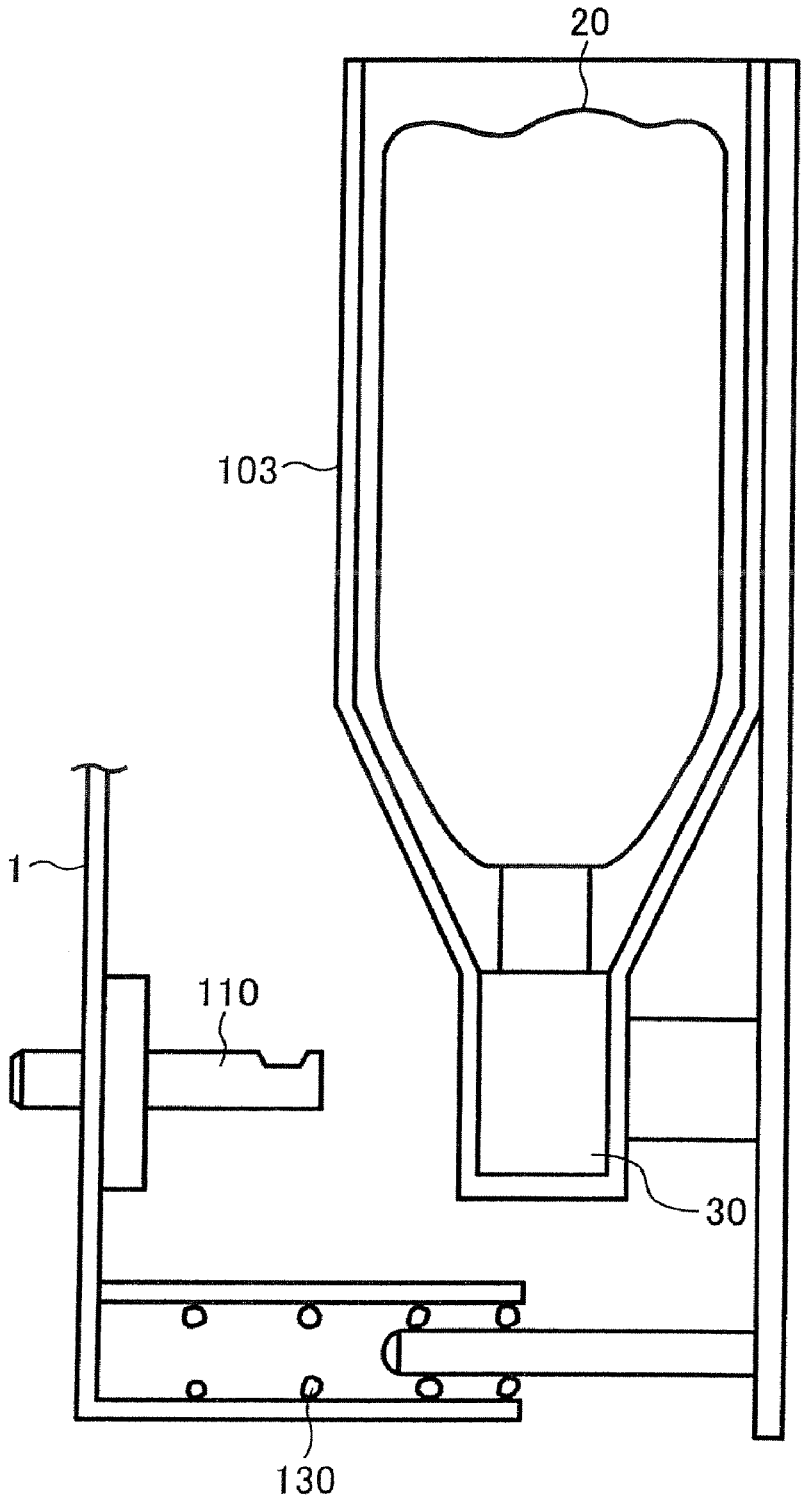
FIG. 18 is an explanatory diagram of the setting unit in FIG. 17 in the opened state.

FIGS. 17 and 18 are another configurational example of the setting unit, in which the opening-closing folder 103 can be slid in a direction of arrow E by a linear guide unit, and is opened or closed with respect to the apparatus body 1 by the slide.

The opening-closing folder 103 is fitted to the apparatus body 1 via the linear guide 130, and as shown in FIG. 18, when the opening-closing folder 103 is pulled out, the nozzle 110 is detached from the cap member 30, so that the toner container 20 can be detached. In this state, when the toner container 20 is replaced by a new one and the opening-closing folder 103 is dropped therein, the nozzle 110 is set to the cap member 30, and the toner can be supplied to the developing unit.

Figure 19:
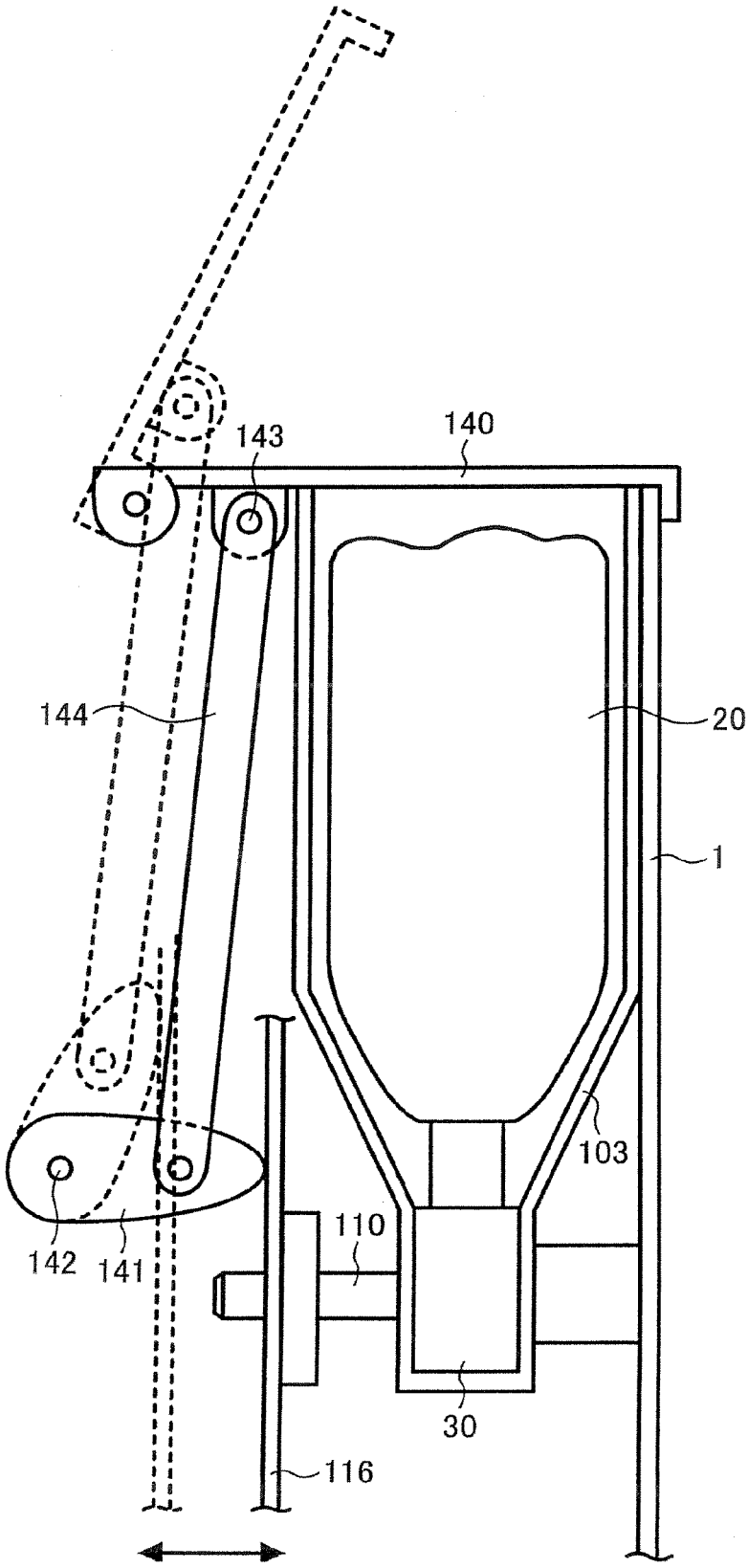
FIG. 19 is an explanatory diagram of another configurational example of the setting unit of the toner container.

FIG. 19 is another configurational example of the setting unit, in which the opening-closing folder 103 is fixed to the apparatus body 1 and does not move. On the other hand, a door 140 is provided at the top thereof for detaching the toner container 20. A nozzle support member 116 that supports the nozzle 110 is supported so as to be able to act directly in a direction of arrow F by a linear guide unit, not shown. The nozzle support member 116 is moved in the direction of arrow by a cam 141 rotating about a fulcrum 142. On the other hand, the door 140 rotates about a fulcrum 143.

In such a configuration, by connecting the cam 141 and the door 140 by an arm 144 as shown in the figure, the rotation of the cam 141 is synchronized with opening or closing of the door 140, so that the nozzle 110 can be detached or set. Therefore, when the door 140 is opened, the nozzle 110 is detached from the cap member 30, so that replacement and detachment of the toner container 20 becomes possible. When the door 140 is closed, the nozzle 110 is set to the cap member 30 via the arm 144, the cam 141, and the nozzle support member 116, so that the toner can be sucked and supplied.

According to the configuration of the present embodiment, a nozzle constituting a part of the toner supply path and coupled to the toner container is provided in the setting unit, and the fitting direction of the toner container to the setting unit and the coupling direction of the nozzle to the toner container are different. Therefore, an image forming apparatus in which the residual toner in the toner container is little can be provided.

According to the configuration of the present embodiment, the setting unit is provided with the opening-closing folder fitted to the apparatus body movably between the closing position at which the toner container is in the set state, and the opening position at which the toner container can be detached, and the toner container is supported by the opening-closing folder. As a result, the opening and closing operation of the opening-closing folder can be used for setting or detaching the nozzle.

According to the configuration of the present embodiment, since the toner container is dropped from above and supported by the opening-closing folder in the setting unit, setting of the toner container can be facilitated.

According to the configuration of the present embodiment, since the guide member that guides the toner container dropped into the opening-closing folder to the installation position is provided, the dropped toner container is guided to the proper setting position, thereby reducing a setting error.

According to the configuration of the present embodiment, since the nozzle is coupled to the toner container by the shift of the opening-closing folder from the opening position to the closing position, special operation for coupling the nozzle to the toner container is not necessary.

According to the configuration of the present embodiment, since the opening-closing folder is fitted to the apparatus body rotatably between the closing position and the opening position, detachment of the nozzle can be performed by using the rotation operation thereof.

According to the configuration of the present embodiment, since the opening-closing folder is fitted to the apparatus body slidably between the closing position and the opening position, detachment of the nozzle can be performed by using the sliding operation thereof.

According to the configuration of the present embodiment, since the locking unit that locks the opening-closing folder at the closing position is provided, the opening-closing folder can be reliably held at the closing position.

According to the configuration of the present embodiment, the toner container includes: the storage member that stores the toner; the cap member provided below the storage member and having a toner draining unit formed therein; and the shutter member that closes the toner draining unit, wherein the nozzle is inserted into the position of the shutter member and connected to the toner draining unit, by the shift of the opening-closing folder from the opening position to the closing position. As a result, the shutter member is shifted by the insertion of the nozzle, so that the toner can be supplied.

According to the configuration of the present embodiment, the opening-closing folder is provided with the returning unit that returns the shutter member shifted by the insertion of the nozzle to the original position for closing the toner draining unit. Therefore, when the nozzle is pulled out from the cap member, the shutter member closes the toner draining unit, to prevent toner leakage at the time of pulling out the nozzle.

According to the configuration of the present embodiment, the returning unit includes a slider slidable in the shift direction of the shutter member, and an elasticity applying member that applies an elastic force to the slider in a direction of returning the shutter member. As a result, the shutter member can be returned to the original position by the elasticity applying member.

According to the configuration of the present embodiment, since the nozzle is slidably supported by the opening-closing folder, it can be prevented that the nozzle abuts against the cap member and is not connected.

According to the configuration of the present embodiment, since the nozzle is formed integrally with the slider, such a problem that only the nozzle is pulled out and the shutter member does not return to the original position can be reliably prevented.

[Second Embodiment]

A second embodiment according to the present invention will be explained below.

An example of the image forming apparatus (color laser printer) according to the second embodiment is similar to that shown in FIG. 1. Further, the toner supply container, the toner supplying apparatus, and the setting unit are the same as those shown in FIGS. 2 to 19. Therefore, repeated explanation is omitted, and only a characteristic point of the second embodiment will be explained herein.

As shown in FIG. 2, a bag-like container 21 as the toner container 20 is formed of a sheet material, being the flexible material, and hence has flexibility. The bag-like container 21 includes, as shown in FIG. 3, two sheets 21*a* and 21*b* constituting front and back surfaces, two sheets 21*c* and 21*d* constituting left and right sides, and an upper surface sheet 21*e*, and is formed by fusing these sheets. In the sheets 21*c* and 21*d* on the left and right sides, a fold 22 for folding inward of the container is formed, and when the toner is filled, the fold 22 expands to form the container shape, and when the container is empty, the sheets 21*c* and 21*d* are folded along the fold 22, with the front and back sheets 21*a* and 21*b* sticking or becoming adjacent to each other.

On the detachment side of the nozzle of the shutter hole 41, a draining port 41*a* for draining the toner in the toner container 20 toward the developing unit is provided. The draining port 41*a* is located at one end of the toner container 20, and the direction of the opening is different from the direction directed from the other end to the one end of the toner container 20. Particularly, in the present embodiment, the direction of the opening is at right angles with respect to the direction from the other end to the one end of the toner container 20.

By inserting the shutter member 50 into the shutter hole 41, the toner draining port 41*a* of the shutter hole 41 can be closed by the shutter member 50.

When the cap member 30 is disassembled, after the upper part 37 is detached from the lower part 46, a cylindrical takeout tool is inserted from a through hole 48 for disassembly formed on the lower wall of the lower part 46, to push up the inner part 45. As a result, the inner part 45 can be easily detached from the lower part 46.

When the cap member 30 is formed of two parts, the inner hole 33 is formed, spanned over the external part 34 and the middle part 43. On the other hand, when the cap member 30 is formed of three parts, the inner hole 33 spans over the upper part 37 and the inner part 45. The funnel-shaped narrowed portion 33*a* is formed in the inner hole 33, and in the both embodiments, the narrowed portion 33*a* is formed in the middle part 43 and the inner part 45, being the inside part.

In the present embodiment, a circuit substrate 70 is fitted in the lower part 46. The circuit substrate 70 has en electric circuit and a memory so as to confirm from the apparatus body side the installation of the toner container 20, or the amount of the residual toner in the toner container 20. When the toner container 20 is installed in the apparatus body, a joining terminal on the circuit substrate 70 comes in contact with a joining terminal on the apparatus body side, to transfer information between the circuit substrate 70 and the apparatus body, so as to confirm the installation of the toner container 20, or the amount of the residual toner in the toner container 20.

As described above, the toner is filled in the toner container 20 in a factory. However, in the toner container 20, it is difficult to fill the toner from the shutter hole 41, since it is via the inner hole 33 facing a different direction. Further, filling by forming a filling opening in the bag-like container 21 itself, and by using this opening is also difficult, because the container expands due to the filled toner, and hence sealing of the container is difficult. Therefore, in the toner container 20 in the above two embodiments, before the middle part 43 or the inner part 45 is fitted, the inner hole 33 is a relatively large opening, because the narrowed portion 33*a* is not formed in the inner hole 33. Therefore, if the toner is filled before the middle part 43 or the inner part 45 is fitted, the filling operation can be easily conducted, and thereafter, by fitting the middle part 43 or the inner part 45, the container becomes the sealed state. Thus, if the cap member 30 is formed of the two parts or the three parts, filling of the toner becomes easy, since the toner container 20 can be detached from a part as a powder draining member having a draining port. Here, the powder draining member is the middle part 43 in the example of the two-part cap member 30, and the inner part 45 and the lower part 46 in the example of the three-parts cap member 30. The toner container 20 using the two-part cap member 30 requires two actions of fitting the middle part 43 to the external part 34 after filling the toner, and inserting the shutter member 50 therein. However, with the toner container 20 using the three-parts cap member 30, by fitting the inner part 45 to the lower part 46, and inserting the shutter member 50 therein beforehand, only one action of coupling the lower part 46 to the upper part 37 is required after filling the toner, and hence it is more preferable.

The configuration of the fitting portion of the toner container 20 having the above configuration to the image forming apparatus body 1 will be explained next.

In the thus configured setting unit 100, when the opening and closing handle 120 is pulled forward while being pushed down, the locking unit 121 comes off from the locking groove 123 formed in the machine frame 101, and hence, as shown in FIG. 14, the bottom of the opening-closing folder 103 can be rotated about the rotation shaft 102 up to the position where the bottom of the opening-closing folder 103 abuts against the machine frame 101, so that the opening-closing folder 103 is shifted to the opening position. The opening-closing folder 103 at the opening position is in the state that the nozzle 110 is pulled to the left side in FIG. 14. Here, when the toner container 20 is dropped with the cap member 30 side facing downward, since the nozzle 110 is held at a position where the engaging claw 112 abuts against the guide member 104 by the compression spring 113, the shutter member 50 in the cap member 30 drops to a position opposite to the nozzle 110. This position is an unset position of the toner container 20 at which the nozzle 110 is detached from the shutter hole 41.

After the toner container 20 is dropped to a predetermined position, the opening-closing folder 103 is returned to the original closing position shown in FIG. 13. By this returning action, the nozzle 110 is fitted into the shutter hole 41, and the toner container 20 is located at the installation position. Synchronized with this, the shutter member 50 is shifted from the hole 105*a* toward the guide cylinder 105. Atoner receiving port 114 is provided on the nozzle 110, on the upper part of the periphery thereof near the end, and the toner receiving port 114 communicates with the lower part of the inner hole 33 provided in the cap member 30, thereby forming a toner supply path from the toner container 20 to the developing unit 14. The shutter member 50 pushed out toward the guide cylinder 105 by the insertion of the nozzle 110 is held at a position spanning over the shutter hole 41 and the guide cylinder 105, without coming off completely from the shutter hole 41.

As in the present embodiment, when the bag-like container 21 is formed of flexible sheets, in the conventional configuration in which it has been necessary to push the toner container 20 downward until the nozzle 110 is inserted in the toner draining port 41*a*, at the time of installing the toner container, an unexpected force is applied to the toner container 20. Hence, an unexpected deformation may occur in the bag-like container 21 of the toner container 20, thereby applying an unexpected force to the toner inside thereof, or causing a distortion in the bag-like container 21 itself. When the bag-like container 21 is distorted, there is the possibility that the toner therein may be blocked by the internal surface of the container and remain in the container, and hence the toner is not used for the development and remains therein.

In the present embodiment, since the toner container 20 is just dropped from above, and it is not necessary to press the toner container 20 from above, and insertion or detachment of the nozzle 110 can be carried out by a sliding movement in the horizontal direction, it can be avoided that the bag-like container 21 is distorted, or the inside toner remains therein.

In the present embodiment, when the toner container 20 is installed in the image forming apparatus body, the toner draining port 41*a* is opened in a direction different from the direction of gravity. Particularly, in the present embodiment, the toner draining port 41*a* is opened toward the horizontal direction. Thus, by setting the direction of the toner draining port 41*a*, even if the toner in the toner container 20 drops due to the gravity, the toner is unlikely to from the toner draining port 41*a* to the outside. In addition, at the time of supplying the toner to the developing unit, it is not necessary to take out the toner from the toner container 20 against the gravity, like when the toner draining port 41*a* faces upward than the horizontal direction. Accordingly, the effect of preventing the toner from leaking outside of the toner container 20 can be further increased, and an excessive force is not necessary when the toner is taken out from the toner container 20.

In the present embodiment, the cap member 30 can be divided into two parts or three parts. However, instead of this, the whole toner container 20 including the bag-like container 21 and the cap member 30 may be integrally formed. When the whole toner container 20 is integrally formed, the number of parts can be reduced. For this, it can be considered to form a filling opening in the bag-like container 21 itself, in order to fill a new toner in the bag-like container 21.

Figure 20:
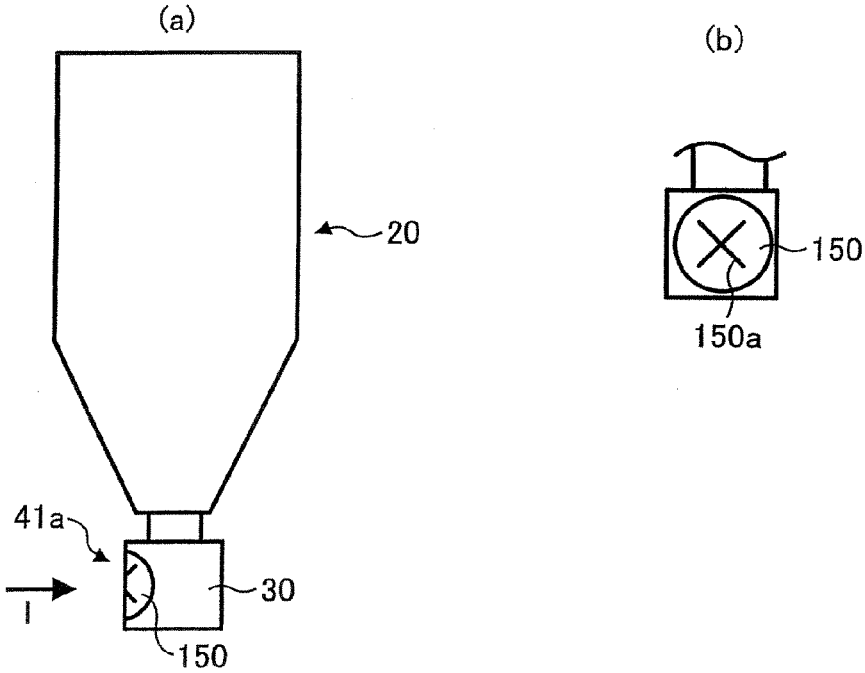
FIG. 20(*a*) is a front elevation of the cap member according to another modification example.
Figure 21:
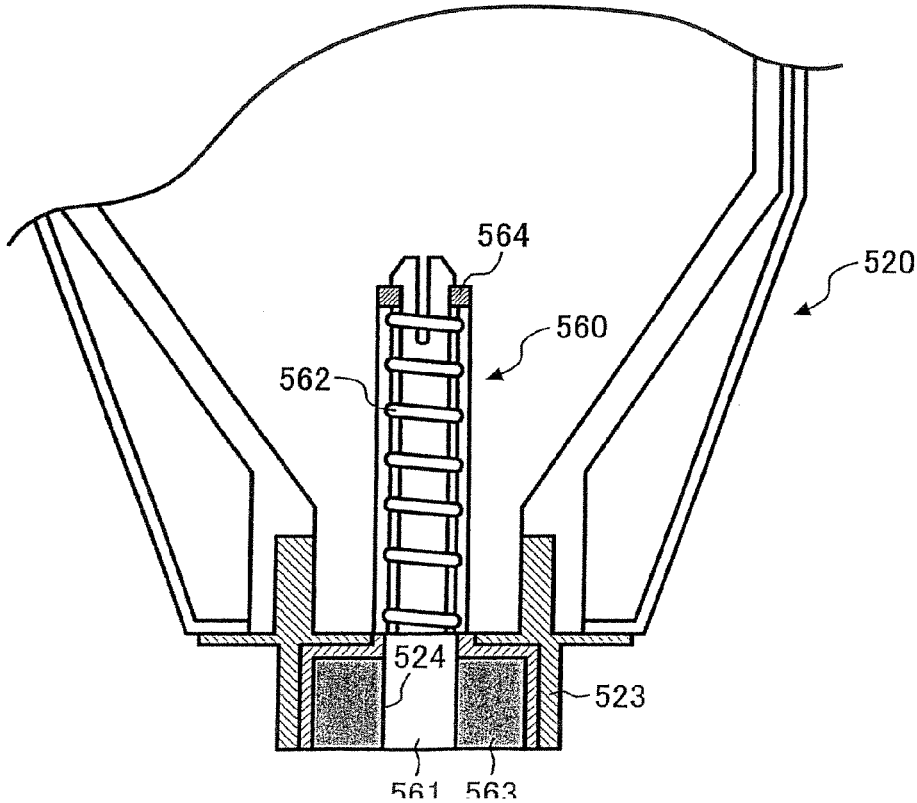
FIG. 21 is a cross section of a conventional toner container.
Figure 22:
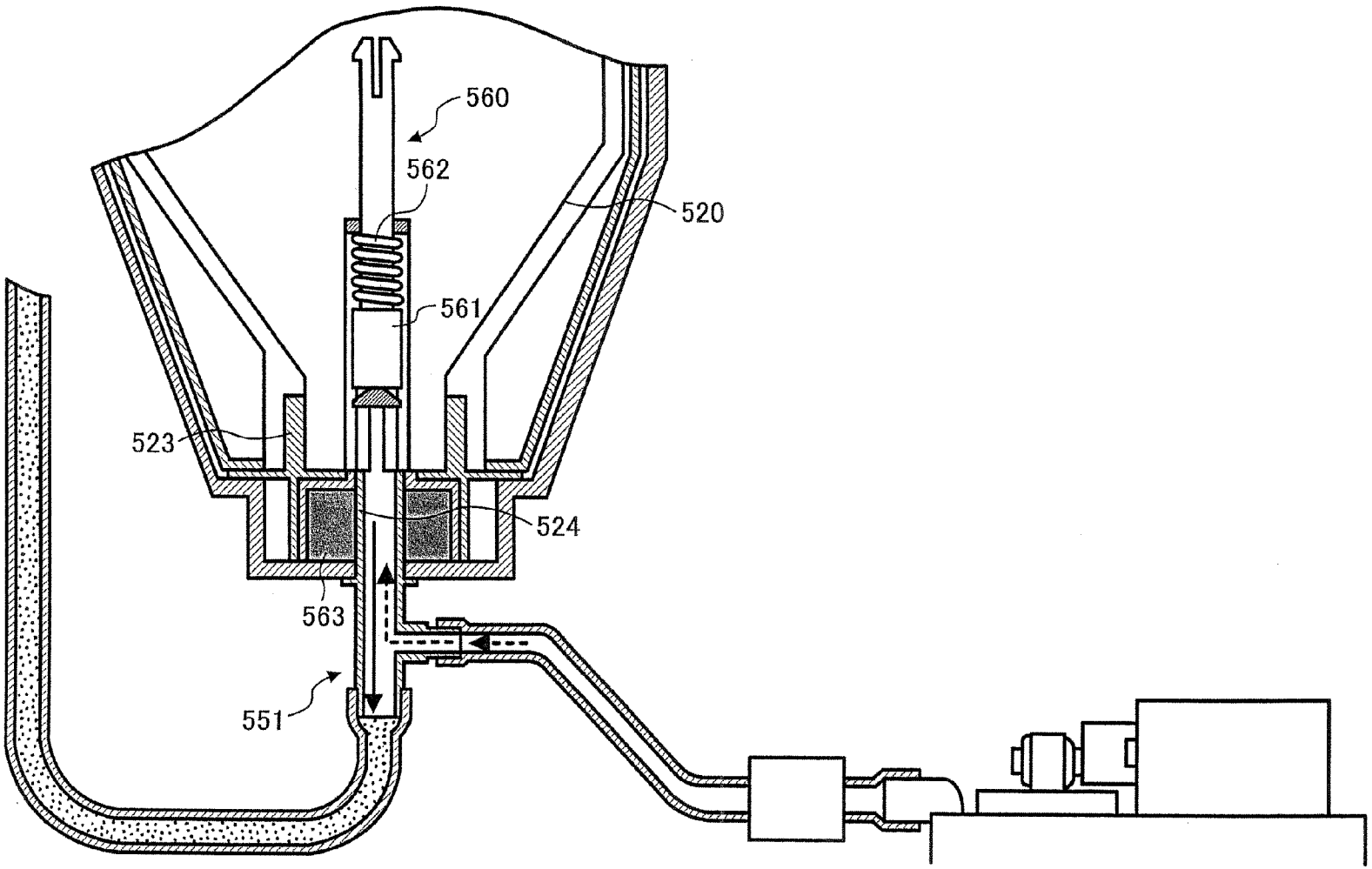
FIG. 22 is a cross section of the state at the time of setting the toner container shown in FIG. 21.
Figure 23:
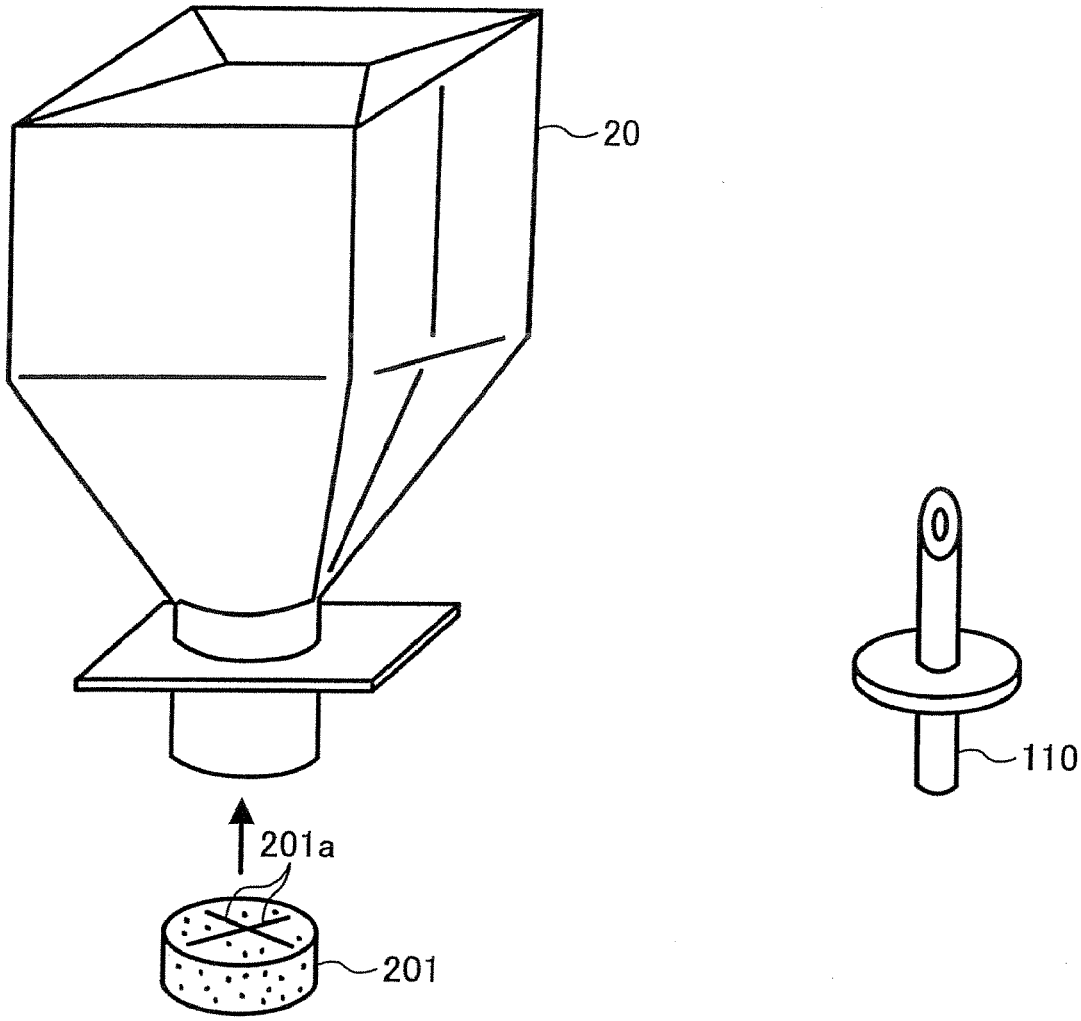
FIG. 23 is an explanatory diagram of a toner container having a conventional self-closing valve.

FIG. 20(*a*) is a front elevation of the cap member according to a modification example. FIG. 20(*b*) is a side view of the cap member shown in FIG. 20(*a*) as seen from a direction of arrow I in FIG. 20(*a*). In these figures, the toner draining port 41*a* is provided on the left side in the figure, in order to install the opening-closing folder shown in FIGS. 17 and 18 in the image forming apparatus body. The toner draining port 41*a* facing the horizontal direction is provided in the cap member, and a self-closing valve 150 is provided for inserting or detaching the nozzle into or from the toner draining port 41*a*. A cross-shaped slit 150*a* is formed in the self-closing valve 150, and when the nozzle 110 is inserted into the cross-shaped slit 201*a*, the slit deforms so as to receive it, and when the nozzle 110 is pulled out, the slit is closed due to the righting moment of the sponge.

In the configuration in which the self-closing valve is provided in the conventional toner container 20, the self-closing valve faces the direction of gravity. Therefore, when the righting moment of the sponge decreases due to curing at a low temperature or a creep deformation with the lapse of time, a slight gap may be generated in the slit in the self-closing valve, at the time of insertion or detachment of the nozzle. When a gap is generated, the toner may drop, leak from the gap, and scatter, in the conventional configuration.

On the other hand, in the cap member shown in FIG. 20, the toner draining port 41*a* is opened toward the horizontal direction. By setting the direction of the toner draining port 41*a* in this manner, even if a slight gap is generated in the slit 150*a* of the self-closing valve, the toner in the toner container 20 is unlikely to leak from the toner draining port 41*a* to the outside.

In the embodiment, the toner in the two-component developer including the toner and the carrier is consumed accompanying the image formation. Therefore, an example is explained, in which the present invention is applied to the toner container, the toner supplying apparatus, and the image forming apparatus, which are used to sequentially supply the toner by a consumed amount. However, the present invention is applicable not only to the apparatus that supplies only the toner, but also to the apparatus that supplies a developer, such as the one supplying the two-component developer including the toner and the carrier, or the one supplying a one-component developer including only the toner.

According to the present embodiment, since the toner passage from the bag-like container 21 to the draining port is bent at one spot or more, when the bag-like container 21 is located above the cap member 30, the toner in the bag-like container 21 does not linearly move toward the draining port due to the gravity. Further, when the bag-like container 21 is located above the cap member 30, since at least a part of the portion from the bent portion of the toner passage to the draining port inclines with respect to the perpendicular direction, the toner moving in the direction of gravity can be received by the internal wall of the inclined portion. Therefore, when the bag-like container 21 is located above the cap member 30, leakage of the toner from the draining port can be suppressed, when the toner container 20 is detached.

Particularly, in the present embodiment, the toner passing direction in a portion near the draining port of the shutter hole 41 is inclined with respect to the toner passing direction in the inner hole 33 as the powder passage in the external part 34 (the upper part 37) as the base member. Therefore, when the toner container 20 is detached in the state with the bag-like container 21 located above the draining port member, the internal surface near the draining port of the shutter hole 41 inclines with respect to the vertical direction. As a result, the toner trying to move in the direction of gravity near the draining port of the shutter hole 41 can be received by the internal surface near the draining port of the shutter hole 41, thereby further suppressing the toner leakage from the draining port, at the time of detaching the toner container 20.

According to the present embodiment, since the bag-like container 21 is formed of a flexible material, after the toner container 20 has been used, the bag-like container 21 can be deformed so as to decrease the volume thereof, thereby enabling a reduction in size of the used toner container 20.

According to the present embodiment, the shutter member 50 provided in the middle part 43 (the inner part 45) as the draining port member moves between the position where the inlet on the bag-like container 21 side of the shutter hole 41 as the drain passage is opened and the position where the inlet is closed, thereby enabling opening or closing of the shutter hole 41. Therefore, toner leakage due to a decrease in the righting moment of the elastic body, which has occurred when the conventional sealing material formed of an elastic body is used, can be prevented.

According to the present embodiment, since the shutter hole 41 as the drain passage is a through hole opened to the outside of the toner container 20, the shutter member 50 is shifted by the insertion of the nozzle for draining the toner, thereby enabling automatic opening of the drain passage. Further, since the shutter member 50 moving in the shutter hole 41 due to the insertion of the nozzle 110 does not come into the bag-like container 21 side, it can be prevented that a large amount of toner remains in the toner container 20.

According to the present embodiment, the nozzle 110 is set to or detached from the shutter hole 41 according to opening or closing of the opening-closing folder 103. As a result, the toner container 20 can be easily detached.

According to the present embodiment, the shutter member 50 is shifted to the position for closing the shutter hole 41, synchronized with the detachment operation of the nozzle 110 from the shutter hole 41. Therefore, the shutter hole 41 can be closed by the shutter member 50, even when the nozzle 110 is detached from the shutter hole 41 at the time of setting or detaching the toner container, thereby preventing leakage of the toner and toner scattering more effectively.

Closing of the shutter hole 41 by the shutter member 50 is released, synchronized with the setting operation of the nozzle 110 to the shutter hole 41. Therefore, opening or closing of the shutter hole 41 by the shutter member 50 can be automatically performed, synchronized with attachment or detachment of the nozzle 110 with respect to the shutter hole 41. Accordingly, timing control for moving the shutter member is not necessary, thereby enabling easy prevention of toner scattering.

Further, the nozzle 110 and the shutter member 50 may be integrally formed, by which the shutter member 50 can close the shutter hole 41, synchronized with the movement of the nozzle 110.

According to the present embodiment, the opening-closing folder 103 is provided as the powder container supporting member that movably supports the toner container 20 between the set position where the nozzle 110 is set to the shutter hole 41 of the toner container 20, and the detached position where the nozzle 110 is detached. As a result, the opening-closing folder 103 can be used for shifting the toner container 20 between the set position and the detached position According to the present embodiment, by dropping the toner container 20 from above, with the cap member 30 side facing downward, the toner container 20 can be supported at the predetermined position of the opening-closing folder 103. As a result, setting of the toner container 20 to the opening-closing folder 103 can be performed by an easy operation of dropping the toner container 20.

According to the present embodiment, a guide frame 109 that guides the inserted toner container 20 to the set position is provided in the opening-closing folder 103. The dropped toner container 20 can be guided to a position where the nozzle 110 can be fitted to the toner draining port 41*a* thereof by the guide frame 109, thereby reducing the possibility of an installation error of the toner container 20.

According to the present embodiment, attachment or detachment of the nozzle 110 with respect to the shutter hole 41, performed by the opening or closing operation of the opening-closing folder 103 can be performed by an easy operation of inserting or pulling out the nozzle 110 with respect to the shutter hole 41. As a result, attachment or detachment of the nozzle 110 can be smoothly performed.

According to the present embodiment, opening or closing of the shutter hole 41 by the shutter member 50 is performed, synchronized with the detachment operation of the nozzle 110 with respect to the shutter hole 41, performed by the opening or closing operation of the opening-closing folder 103. Therefore, by the opening or closing operation of the opening-closing folder 103, attachment or detachment of the nozzle 110, and opening or closing of the shutter hole 41 by the shutter member 50 can be automatically performed. As a result, toner scattering can be prevented by an easy operation.

According to the embodiment shown in FIGS. 13 and 14, the compression spring 107 is used for biasing the shutter member 50 toward the toner draining port 41*a*. Therefore, the shutter member 50 can be shifted to the closing position of the toner draining port 41*a* by a resilient biasing force of the compression spring 107, and hence, it is not necessary to provide a drive for shifting the shutter member 50.

In the above embodiment, a toner container that stores the toner as the powder is explained. However, the present invention is similarly applicable to a powder container that stores a two-component developer including the toner and the carrier, and a powder container that stores a powder of other types.

According to the configuration of the embodiment therefore, when the powder storage is located above the powder draining member, the toner in the powder storage does not move linearly toward the draining port due to gravity. Further, since at least a part of the portion from the bent portion of the powder passage to the draining port inclines with respect to the perpendicular direction, the toner moving in the direction of gravity can be received by the internal wall of the inclined portion. Therefore, when the powder storage is located above the powder draining member, leakage of the powder from the draining port can be reduced, when the powder storage is detached.

[Third Embodiment]

A third embodiment according to the present invention will be explained below.

An example of the image forming apparatus (color laser printer) according to the third embodiment is similar to that shown in FIG. 1. Further, the toner supply container, the toner supplying apparatus, and the setting unit are the same as those shown in FIGS. 2 to 19. Therefore, repeated explanation is omitted, and only a characteristic point of the third embodiment will be explained herein.

When the axial length of the shutter member 50 is longer than the width between the front and back surfaces of the cap member 30, that is, the width Wb of the side, the shutter member 50 inserted into the shutter hole 41 protrudes from the cap member 30, and obstructs the installation of the container. Therefore, it is preferable that the length of the shutter member 50 be equal to the width Wb.

In the configuration of the present embodiment, the toner draining port 41*a* has an inner hole 33 on the storage member side, and the shutter hole 41 through which the shutter member 50 can be inserted or taken out, with the inner hole 33 and the shutter hole 41 being communicated with each other with an angle, and the opening for draining the toner 41*a* is opened or closed by inserting or taking out the shutter member 50. As a result, the shutter member 50 does not go into the container, thereby preventing a large amount of residual toner.

In the configuration of the present embodiment, the cap member 30 is provided in the lower part of the storage member, and the inner hole 33 is a longitudinal hole extending vertically, in the state with the cap member 30 facing downward, and the shutter hole 41 is a lateral hole with the axis thereof crossing the axis of the inner hole substantially at right angles. As a result, the shutter member does not go into the container, thereby preventing a large amount of residual toner.

In the configuration of the present embodiment, the opening diameter of the inner hole 33 is smaller than that of the shutter hole 41, in the communicating portion between the inner hole 33 and the shutter hole 41. As a result, the opening for draining the toner 41*a* can be reliably closed by the shutter member 50 inserted into the shutter hole 41.

In the configuration of the present embodiment, the narrowed portion in which the cross-sectional area of the opening decreases toward the shutter hole 41 is formed in the inner hole 33. As a result, the toner can be discharged smoothly and supplied.

In the configuration of the present embodiment, the cap member 30 includes the upper body portion 31 and the lower body portion 40, the upper body portion 31 is provided with the storage-fixing portion 32 to which the storage member is fixed, the lower body portion 40 is provided with the shutter hole 41, and the lower body portion 40 is formed substantially in a rectangular parallelepiped with the width of the front and back surfaces being formed thinner than the width of the opposite sides. As a result, setting of the toner container 20 to the proper position can be facilitated.

In the configuration of the present embodiment, since the taper, the width of which becomes narrow toward the lower part, is formed on the opposite sides of the lower body portion 40, setting of the toner container 20 to the proper position can be facilitated.

In the configuration of the present embodiment, since the shutter hole 41 is a through hole going through from the front surface through to the back surface of the lower body portion 40, the width of the cap member 30 between the front and back surfaces can be made thinner In the configuration of the present embodiment, since the width of the cap member 30 between the front and back surfaces is equal to the axial width of the shutter member 50, there is no possibility that the shutter member 50 obstructs installation of the toner container 20.

In the configuration of the present embodiment, since the sealing unit for sealing the shutter hole 41, into which the shutter member 50 is inserted, is provided, toner leakage can be reliably prevented, and a toner supply path can be made a sealed passage.

In the configuration of the present embodiment, since the shutter hole 41 is circular in cross section and the sealing unit is an O-ring having resilience, provided at the end of the shutter hole, uniform sealing force can be applied over the whole circumference thereof at a reasonable cost.

In the configuration of the present embodiment, since the sealing unit is provided in the shutter member 50, it is not necessary to provide a seal holding unit in the cap member 30.

In the configuration of the present embodiment, the cap member 30 includes the middle part 43 and the external part 34, the middle part 43 is provided with the engaging groove 44 with which the sealing unit is engaged, and the external part 34 is provided with the fitting portion 35 to which the middle part 43 is fitted, the storage-fixing portion 35 to which the storage member is fixed, and the holding portion 36 for holding the sealing unit engaged with the engaging groove 44. As a result, the sealing unit can be easily assembled, and reliably held.

In the configuration of the present embodiment, the shutter hole 41 is formed in the cap member 30, spanned over the middle part 43 and the external part 34, and the cap member 30 is assembled by inserting the shutter member 50 into the shutter hole 41, with the sealing unit held by the middle part 43 and the external part 34. As a result, a member or means for binding the middle part 43 and the external part 34 is not required.

In the configuration of the present embodiment, the inner hole 33 provided in the cap member 30 is formed, spanning over the middle part 43 and the external part 34, and the narrowed portion formed in the inner hole 33 is also formed in the middle part 43, with the cross-sectional area of the opening decreasing toward the shutter hole 41. As a result, by detaching the middle part 43, the toner can be filled easily.

In the configuration of the present embodiment, the cap member 30 includes the upper part 37, the inner part 45, and the lower part 46, wherein the storage-fixing portion 32 to which the storage is fixed is provided in the upper part 37, the engaging groove 44 with which the sealing unit is engaged is provided in the inner part 45, and the fitting portion 35 to which the inner part 45 is fitted, and the holding portion 36 for holding the sealing unit engaged with the engaging groove 44 are provided in the lower part 46. As a result, the sealing unit is easily assembled and reliably held, and when the toner container 20 is disposed, only the bag-like container 21 and the upper part 37 are disposed, and the inner part 45 and the lower part 46 can be reused.

In the configuration of the present embodiment, the cap member 30 is provided with the coupling unit that detachably couples the upper part 37 and the lower part 46, the sealing unit is held by fitting the inner part 45 to the fitting portion in the lower part 46, and the cap member 30 is assembled by coupling the lower part 46 that holds the sealing unit by fitting of the inner part 45, to the upper part by the coupling unit. As a result, the assembly work is facilitated, and the assembly can be completed by one action after filling the toner.

In the configuration of the present embodiment, the coupling unit includes the fixed guide 38 provided on the lower opposite sides of the upper part 37, and the guide support 47 provided on the upper opposite sides of the lower part 46, and the fixed guide 38 and the guide support 47 are engaged with each other by the rotation of one of the upper part 37 and the lower part 46 with respect to the other thereof. As a result, the assembly work is facilitated.

In the configuration of the present embodiment, the rotation of one of the upper part 37 and the lower part 46 with respect to the other thereof for allowing the engagement of the fixed guide 38 with the guide support 47 is a rotation about the axis of the inner hole 33. As a result, a deviation hardly occurs in the inner hole 33 due to the coupling of the upper part 37 and the lower part 46.

In the configuration of the present embodiment, the fixed guide 38 and the guide support 47 are respectively provided with the locking unit that locks the upper part 37 and the lower part 46 when these are coupled properly. As a result, the assembly accuracy is improved, thereby preventing defective assembly.

In the configuration of the present embodiment, the inner hole 33 provided in the cap member 30 is formed, spanned over the upper part 37 and the inner part 40, and the narrowed portion formed in the inner hole 33, with the cross-sectional area of the opening decreasing toward the shutter hole 41, is formed in the inner part 40. As a result, the toner can be filled easily in the state that there are no inner part 37 and lower part 46.

In the configuration of the present embodiment, when the toner container 20 having the storage member that stores toner, and the cap member 30 integrally formed with or fixed to the storage member, and having the opening for draining the toner 41*a* formed therein, in which the opening for draining the toner 41*a* has the inner hole 33 on the storage member side, and the shutter hole 41 through which the shutter member 50 can be inserted or taken out, with the inner hole 33 and the shutter hole 41 being communicated with each other with an angle, is set in the apparatus body 1, the shutter member 50 is shifted by the nozzle 110 provided in the apparatus body 1. Therefore, the shutter member 50 does not go into the container, thereby providing an image forming apparatus using the toner container 20 that prevents a large amount of residual toner.

[Fourth Embodiment]

A fourth embodiment according to the present invention will be explained below.

An example of the image forming apparatus (color laser printer) according to the second embodiment is similar to that shown in FIG. 1. Further, the toner supply container, the toner supplying apparatus, and the setting unit are the same as those shown in FIGS. 2 to 19. Therefore, repeated explanation is omitted, and only a characteristic point of the fourth embodiment will be explained herein.

As described above, the toner passage including the inner hole 33 as a relay passage on the bag-like container 21 side, and the shutter hole 41 as the drain passage through which the shutter member can be inserted and taken out, and communicated with the inner hole 33, is formed in the cap member 30. The inner hole 33 is a longitudinal hole extending vertically, with the cap member 30 facing downward. On the other hand, the shutter hole 41 is a lateral hole with the axis thereof crossing the axis of the inner hole 33 substantially at right angles. The shutter hole 41 in the present embodiment is a through hole circular in cross section going through from the front surface through to the back surface of the lower body portion 40. The inner hole 33 is a hole circular in cross section, designating the length in a minor direction inside of the bag-like container-fixing portion 32 having a boat shape as a diameter, and includes a funnel-shaped narrowed portion 33*a* formed halfway therein. That is, the inner hole 33 has a reduced diameter halfway by the narrowed portion 33*a* so that the opening area decreases toward the shutter hole 41, and is communicated with the shutter hole 41 above thereof. Therefore, in a communicating portion between the inner hole 33 and the shutter hole 41, the opening diameter of the inner hole 33 becomes smaller than that of the shutter hole 41. When the cylindrical shutter member 50 is inserted in the shutter hole 41, the opening for draining the toner is reliably closed. If the axial length of the shutter member 50 is longer than the width between the front and back surfaces of the cap member 30, that is, the width Wb of the side, the shutter member 50 inserted into the shutter hole 41 protrudes from the cap member 30, and obstructs the installation of the container. Therefore, it is preferable that the length of the shutter member 50 be equal to the width Wb.

When the cap member 30 is disassembled, after the upper part 37 is detached from the lower part 46, a cylindrical takeout tool is inserted from a through hole 48 for disassembly formed on the lower wall of the lower part 46, to push up the inner part 45. As a result, the inner part 45 can be easily detached from the lower part 46.

In the present embodiment, the circuit substrate 70 is fitted in the lower part 46. The circuit substrate 70 has en electric circuit and a memory so as to confirm from the apparatus body side the installation of the toner container 20, or the amount of the residual toner in the toner container 20. When the toner container 20 is installed in the apparatus body, a joining terminal on the circuit substrate 70 comes in contact with a joining terminal on the apparatus body side, to transfer information between the circuit substrate 70 and the apparatus body, so as to confirm the installation of the toner container 20, or the amount of the residual toner in the toner container 20.

Recycling of the toner container 20 after the use of the toner therein has finished can be carried out in the following manner.

For example, by releasing the engagement between the base member (the external part 34 and the upper part 37) and the draining port member (the middle part 43, the inner part 45, and the lower part 46) constituting the cap member 30 of the used toner container 20, the draining port member is detached from the base member. After detachment of the draining port member, the toner is refilled in the bag-like container 21 from the exposed opening in the base member. After having filled the toner, the base member and the draining port member are coupled by engagement thereof. By reproducing the toner container 20 in this manner, the bag-like container 21, the base member (the external part 34 and the upper part 37), and the draining port member (the middle part 43, the inner part 45, and the lower part 46) can be recycled and reused.

After detaching the draining port member, another base member (external part 34 and upper part 37) fitted to the bag-like container 21 in which the new toner has been filled may be engaged with the detached draining port member. By reproducing the toner container 20 in this manner, the draining port member (the middle part 43, the inner part 45, and the lower part 46) can be recycled and reused.

According to the present embodiment, when the use of the toner container 20 has finished, the engagement between the base member (the external part 34 and the upper part 37) and the draining port member (the middle part 43, the inner part 45, and the lower part 46) constituting the cap member 30 is released. By such a simple operation of releasing the engagement between these members, the draining port member can be detached from the used toner container 20. Therefore, a complicated operation of detaching the bonded elastic sealing material in the toner draining member, which has been required in the conventional toner container, is not necessary. Therefore, the bag-like container 21 as the bag-like powder storage, the base member, and the draining port member can be easily recycled as an individual part. Further, the opening communicating with the inside of the bag-like container 21 is exposed to the outside by the detachment of the draining port member, and the powder can be filled from the exposed opening. As a result, the bag-like container 21 can be easily recycled by refilling the toner in the bag-like container 21.

According to the present embodiment, the opening area at the outlet of the inner hole 33 of the external part 34 (upper part 37) as the base member is larger than that of the shutter hole 41 as the powder draining portion in the middle part 43 (inner part 45) as the draining port member. Thus, since the opening area at the outlet of the inner hole 33 of the external part 34 (upper part 37) is larger than that of the shutter hole 41 in the middle part 43 (inner part 45), the toner can be easily filled from the outlet of the inner hole 33 of the external part 34 (upper part 37) exposed by detaching the middle part 43 (inner part 45). Further, since the opening area of the shutter hole 41 in the middle part 43 (inner part 45) can be kept small, leakage of the toner from the shutter hole 41 can be suppressed.

According to the present embodiment, the cross-sectional area of the opening of the inner hole 33 as the powder passage in the external part 34 (upper part 37) as the base member, in a direction of the face orthogonal to the toner passing direction decreases from the opening side of the bag-like container 211 as the powder storage toward the middle part 43 (inner part 45) as draining port member. Thus, since the narrowed portion 33*a* is formed such that the cross-sectional area of the opening of the inner hole 33 in the external part 34 (upper part 37) gradually decreases, the residual toner in the inner hole 33 can be reduced, and the toner received from the bag-like container 21 side can be allowed to pass smoothly toward the middle part 43 (inner part 45) side.

According to the present embodiment, since the shutter member 50 provided in the middle part 43 (inner part 45) as the draining port member moves between the position for opening the inlet of the shutter hole 41 as the drain passage on the bag-like container 21 side and the position for closing the inlet, the shutter hole 41 can be opened or closed. Therefore, leakage of the toner due to a drop in the righting moment of the elastic body, which has occurred heretofore when the conventional sealing material formed of the elastic body is used, can be prevented.

According to the present embodiment, since the shutter hole 41 as the drain passage is a through hole opened to the outside of the toner container 20, the shutter member 50 is moved by inserting the nozzle for draining the toner, to automatically open the drain passage. Further, since the shutter member 50 moving in the shutter hole 41 due to the insertion of the nozzle 110 does not come into the bag-like container 21 side, it can be prevented that a large amount of toner remains in the toner container 20.

According to the present embodiment, the toner passage from the bag-like container 21 to the draining port is bent at one spot or more. Therefore, when the bag-like container 21 is located above the cap member 30, the toner in the bag-like container 21 does not move linearly toward the draining port by the gravity. Further, when the bag-like container 21 is located above the cap member 30, since at least one part of the portion from the bent portion to the draining port of the toner passage inclines with respect to the perpendicular direction, the toner likely to move in the direction of gravity can be received by the internal wall of the inclined portion. Therefore, when the bag-like container 21 is located above the cap member 30, leakage of the toner from the draining port can be suppressed, at the time of setting or detaching the toner container 20.

Particularly, in the present embodiment, the toner passing direction near the draining port of the shutter hole 41 is inclined with respect to the toner passing direction in the inner hole 33 as the powder passage in the external part 34 (upper part 37) as the base member. Therefore, when the toner container 20 is detached in the state that the bag-like container 21 is located above the draining port member, the internal wall of the shutter hole 41 near the draining port inclines with respect to the perpendicular direction. Accordingly, the toner likely to move in the direction of gravity near the draining port of the shutter hole 41 can be received by the internal wall near the draining port of the shutter hole 41, and hence toner leakage from the draining port can be further suppressed at the time of setting or detaching the toner container 20.

According to the present embodiment, since the bag-like container 21 is formed of a flexible material, after the use of the toner container 20 has finished, the bag-like container 21 can be deformed so as to reduce the volume thereof. As a result, the volume of the used toner container 20 can be reduced.

According to the present embodiment, the opening diameter of the inner hole 33 is smaller than that of the shutter hole 41, at the communicated portion between the inner hole 33 continuously formed over the external part 34 (the upper part 37) and the middle part 43 (the inner part 45), and the shutter hole 41 in the middle part 43 (the inner part 45). Therefore, the shutter member 50 inserted in the shutter hole 41 can reliably close the toner draining unit.

According to the present embodiment, the cap member 30 includes the upper body portion 31 and the lower body portion 40, the upper body portion 30 is provided with the bag-like container-fixing portion 32 to which the bag-like container 21 is fixed, and the lower body portion 40 is provided with the shutter hole 41. The lower body portion 40 is formed substantially in a rectangular parallelepiped, with the width of the front and back surfaces formed thinner than that of the opposite sides. As a result, setting of the toner container 20 to the proper position can be facilitated.

According to the present embodiment, since the taper, the width of which becomes narrow toward the lower part, is formed on the opposite sides of the lower body portion 40, setting of the toner container 20 to the proper position can be facilitated.

According to the present embodiment, since the shutter hole 41 is a through hole going through from the front surface through to the back surface of the lower body portion 40, the width between the front and back surfaces of the cap member 30 can be made thinner.

According to the present embodiment, since the width of the cap member 30 between the front and back surfaces is equal to the axial width of the shutter member 50, there is no possibility that the shutter member 50 obstructs installation of the toner container 20.

According to the present embodiment, since the sealing unit for sealing the shutter hole 41, into which the shutter member 50 is inserted, is provided, toner leakage can be reliably prevented, and a toner supply path can be made a sealed passage.

According to the present embodiment, since the shutter hole 41 is circular in cross section and the sealing unit is an O-ring having resilience, provided at the end of the shutter hole, uniform sealing force can be applied over the whole circumference thereof at a reasonable cost.

According to the present embodiment, since the sealing unit 42 is provided in the shutter member 50, it is not necessary to provide a seal holding unit in the cap member 30.

The cap member 30 according to the present embodiment includes the middle part 43 and the external part 34, the middle part 43 is provided with the engaging groove 44 with which the sealing unit 42 is engaged, and the external part 34 is provided with the fitting portion 35 to which the middle part 43 is fitted, the bag-like container fixing portion 32 to which the bag-like container 21 is fixed, and the holding portion 36 for holding the sealing unit 42 engaged with the engaging groove 44. In such a configuration, the sealing unit 42 can be easily assembled, and reliably held.

In the cap member 30 according to the present embodiment, the shutter hole 41 is formed, spanning over the middle part 43 and the external part 34. The cap member 30 is assembled by inserting the shutter member 50 into the shutter hole 41, with the sealing unit 42 held by the middle part 43 and the external part 34. As a result, a member or means for binding the middle part 43 and the external part 34 is not required.

In the cap member 30 according to the present embodiment, the inner hole 33 as the powder passage is formed, spanning over the middle part 43 and the external part 34, and the narrowed portion 33*a* formed in the inner hole 33 is also formed in the middle part 43, with the cross-sectional area of the opening decreasing toward the shutter hole 41. As a result, by detaching the middle part 43, the toner can be filled easily.

The cap member 30 according to the present embodiment includes the upper part 37, the inner part 45, and the lower part 46, and the bag-like container fixing portion 32 to which the bag-like container 21 is fixed is provided in the upper part 37. The engaging groove 46*a* with which the sealing unit 42 is engaged is provided in the inner part 45, and the fitting portion 35 to which the inner part 45 is fitted, and the holding portion 36 for holding the sealing unit 42 engaged with the engaging groove 46*a* are provided in the lower part 46. In such a configuration, the sealing unit 42 is easily assembled and reliably held, and when the toner container 20 is disposed, only the bag-like container 21 and the upper part 37 are disposed, and the inner part 45 and the lower part 46 can be reused.

The cap member 30 according to the present embodiment is provided with the coupling unit that detachably couples the upper part 37 and the lower part 46, and the sealing unit 42 is held by fitting the inner part 45 to the fitting portion 35 in the lower part 46. The cap member 30 is then assembled by coupling the lower part 46 that holds the sealing unit 42 by fitting of the inner part 45, to the upper part 37 by the coupling unit. As a result, the assembly work is facilitated, and the assembly can be completed by one action after filling the toner.

In the cap member 30 according to the present embodiment, the coupling unit includes the fixed guide 38 provided on the lower opposite sides of the upper part 37, and the guide support 47 provided on the upper opposite sides of the lower part 46. The fixed guide 38 and the guide support 47 are engaged with each other by the rotation of one of the upper part 37 and the lower part 46 with respect to the other thereof. As a result, the assembly work is facilitated.

In the cap member 30 according to the present embodiment, the rotation of one of the upper part 37 and the lower part 46 with respect to the other thereof for allowing the engagement of the fixed guide 38 with the guide support 47 is a rotation about the axis of the inner hole. As a result, a deviation hardly occurs in the inner hole due to the coupling of the upper part 37 and the lower part 46.

In the cap member 30 according to the present embodiment, the fixed guide 38 and the guide support 47 are respectively provided with the locking unit that locks the upper part 37 and the lower part 46 when these are coupled properly. As a result, the assembly accuracy is improved, thereby preventing defective assembly.

In the cap member 30 according to the present embodiment, the inner hole 33 as the powder passage is formed, spanned over the upper part 37 and the inner part 45, and the narrowed portion 33*a* formed in the inner hole 33 is also formed in the inner part 45, with the cross-sectional area of the opening decreasing toward the shutter hole 41. As a result, the toner can be filled easily in the state that there are no inner part 45 and lower part 46.

According to the present embodiment, by using the toner container 20 for the toner supplying apparatus in a color laser printer, toner leakage from the toner container 20 can be prevented, and the toner supplying apparatus and the printer, in which recycling of the toner container 20 is easy, can be configured.

In the embodiment, an example in which the base member constituting the cap member 30 has an inner hole 33 as the powder passage through which the toner passes is explained. However, the present invention is also applicable to an example in which the base member does not have the toner passage. For example, as shown in FIG. 16, the toner passage may not be formed in the external part 34 as the base member. In this configuration, the middle part 43 as the draining port member is extended up to the upper end of the external part 34, and a toner passage communicating with the shutter hole 41 as the drain passage is formed inside the middle part 43.

In the embodiment, the toner container that stores the toner as the powder is explained. However, the present invention is similarly applicable to a powder container that stores the two-component developer including the toner and the carrier, and a powder container that stores a powder of other types.

Therefore, according to the configuration of the embodiment, the draining port member can be detached from the used powder container by a simple operation of releasing the engagement between the base member and the draining port member constituting the powder draining member. As a result, the powder storage, the base member, and the draining port member can be easily recycled as an individual part. Further, the opening communicating with the inside of the powder storage is exposed to the outside by the detachment of the draining port member, and the powder can be filled from the exposed opening. As a result, the powder storage can be easily recycled by refilling the powder in the powder storage.

INDUSTRIAL APPLICABILITY

The image forming apparatus, the powder supplying unit, the toner container, the powder container, and the reproduction method thereof according to the present invention are useful for containers or supplying apparatus for toner or the like used for a copier, a printer, or a facsimile, and an apparatus or system using the same, and are particularly suitable for a powder container or a powder supplying unit, which stores and supplies fine powder, that is, handles a powder, and a reproduction method of the storage container.

The invention claimed is:

1. A powder container, comprising:

an upper section configured to store powder;

a multi-part lower section including an upper portion having an opening configured to receive powder directly from the upper section, and a lower portion having an opening perpendicular to the opening of the upper portion configured to discharge powder, the upper portion being rotatably interlocked with the lower portion such that the upper portion and the lower portion are interlocked with each other when rotated to a first position relative to each other, and the upper portion and the lower portion are not interlocked with each other when rotated to second position relative to each other.

2. A powder container according to claim 1, wherein:

the upper portion and the lower portion are rotatably interlocked using a tongue and slot.

3. A powder container according to claim 2, further comprising:

toner.

4. A powder container according to claim 1, wherein:

the upper portion includes two tongues; and the lower portion includes two grooves which rotatably interlock with the tongues.

5. A powder container according to claim 1, wherein:

the multi-part lower section has a trapezoid-shaped cross-section, a width of the trapezoid-shaped cross-section at an upper portion being greater than a width of the trapezoid-shaped cross-section at a lower portion.

6. A powder container according to claim 5, wherein:

both sides of the trapezoid-shaped cross-section have an indentation.

7. A powder container according to claim 6, wherein:

the indentation of each side of the trapezoid-shaped cross-section has a rectangular shape.

8. A powder container according to claim 5, wherein the opening of the lower portion is configured to discharge powder in a direction perpendicular to the trapezoidal-shaped cross-section.

9. A powder container according to claim 8, further comprising:

a second opening in the lower portion disposed opposite to said opening of the lower portion.

10. A powder container according to claim 5, further comprising:

toner.

11. A powder container according to claim 1, further comprising:

a shutter for sealing and unsealing said opening of the lower portion.

12. A powder container according to claim 11, wherein:

said shutter has a cylindrical shape.

13. A powder container according to claim 1, wherein the lower section comprises:

an inner unit; and an outer unit which at least partially surrounds the inner unit.

14. A powder container according to claim 13, wherein:

the inner unit has an opening at a top thereof and an opening at a side thereof.

15. A powder container according to claim 14, wherein:

the outer unit includes an opening at a top thereof and an opening at a side thereof.

16. A powder container according to claim 15, wherein:

the opening at the top of the inner unit corresponds to the opening at the top of the outer unit; and the opening at the side of the inner unit corresponds to the opening at the side of the outer unit.

17. A powder container according to claim 13, further comprising:

an o-ring disposed between the inner and outer units at the opening of the side of the outer unit.

18. A powder container according to claim 17, wherein:

the shutter is slidably disposed inside the o-ring.

19. A powder container according to claim 1, wherein:

the upper section comprises a flexible bag.

20. A powder container, comprising:

an upper section configured to store powder;

means for dispensing powder and sealing the powder container, the means including an upper portion having an opening configured to receive powder directly from the upper section, and a lower portion having an opening perpendicular to the opening of the upper portion configured to discharge powder, the upper portion being rotatably interlocked with the lower portion such that the upper portion and the lower portion are interlocked with each other when rotated to a first position relative to each other, and the upper portion and the lower portion are not interlocked with each other when rotated to second position relative to each other.

21. A powder container according to claim 20, wherein:

the upper portion and the lower portion are rotatably interlocked using a tongue and slot.

22. A powder container according to claim 20, wherein:

the upper portion includes two tongues; and the lower portion includes two grooves which rotatably interlock with the tongues.

23. A powder container according to claim 20, wherein:

the means has a trapezoid-shaped cross-section, a width of the trapezoid-shaped cross-section at an upper portion being greater than a width of the trapezoid-shaped cross-section at a lower portion.

24. A powder container according to claim 23, wherein:

both sides of the trapezoid-shaped cross-section have an indentation.

25. A powder container according to claim 24, wherein:

the indentation of each side of the trapezoid-shaped cross-section has a rectangular shape.

26. A powder container according to claim 23, wherein the opening of the lower portion is configured to discharge powder in a direction perpendicular to the trapezoidal-shaped cross-section.

27. A powder container according to claim 26, further comprising:

toner.

28. A powder container according to claim 20, further comprising:

a shutter for sealing and unsealing said opening of the lower portion.

29. A powder container according to claim 28, wherein:

said shutter has a cylindrical shape.

30. A powder container according to claim 20, wherein the means comprises:

an inner unit; and an outer unit which at least partially surrounds the inner unit.

31. A powder container according to claim 30, wherein:

the inner unit has an opening at a top thereof and an opening at a side thereof.

32. A powder container according to claim 31, wherein:

the outer unit includes an opening at a top thereof and an opening at a side thereof.

33. A powder container according to claim 32, wherein:

the opening at the top of the inner unit corresponds to the opening at the top of the outer unit; and the opening at the side of the inner unit corresponds to the opening at the side of the outer unit.

34. A powder container according to claim 33, further comprising:

an o-ring disposed between the inner and outer units at the opening of the side of the outer unit.

35. A powder container according to claim 34, wherein:

the shutter is slidably disposed inside the o-ring.

36. A powder container according to claim 20, further comprising:

a second opening in the lower portion disposed opposite to said opening of the lower portion.

37. A powder container according to claim 20, further comprising:

toner.

38. A powder container according to claim 20, wherein:

the upper section comprises a flexible bag.

39. A powder container, comprising:

an upper section configured to store powder and comprising a flexible bag;

a multi-part lower section including an upper portion having an opening configured to receive powder directly from the upper section, and a lower portion having an opening perpendicular to the opening of the upper portion configured to discharge powder, the upper portion being rotatably interlocked with the lower portion.

40. A powder container, comprising:

an upper section configured to store powder and comprising a flexible bag;

means for dispensing powder and sealing the powder container, the means including an upper portion having an opening configured to receive powder directly from the upper section, and a lower portion having an opening perpendicular to the opening of the upper portion configured to discharge powder, the upper portion being rotatably interlocked with the lower portion.

* * * * *